US008502159B2

(12) United States Patent
Scott et al.

(10) Patent No.: US 8,502,159 B2
(45) Date of Patent: Aug. 6, 2013

(54) APPARATUSES AND METHODS FOR GENERATING ELECTRIC FIELDS

(75) Inventors: Jill R. Scott, Idaho Falls, ID (US); Timothy R. McJunkin, Idaho Falls, ID (US); Paul L. Tremblay, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 456 days.

(21) Appl. No.: 12/769,894

(22) Filed: Apr. 29, 2010

(65) Prior Publication Data

US 2011/0266428 A1 Nov. 3, 2011

(51) Int. Cl.
*H01J 49/22* (2006.01)
*H01J 49/00* (2006.01)

(52) U.S. Cl.
USPC ..... 250/396 R; 250/288

(58) Field of Classification Search
USPC ..... 250/281, 396 R, 288
See application file for complete search history.

(56) References Cited

U.S. PATENT DOCUMENTS 3,697,450 A 10/1972 Takenaka et al.
4,126,781 A * 11/1978 Siegel ..... 250/281
4,658,137 A 4/1987 Garth et al.
4,704,532 A * 11/1987 Hua ..... 250/292
4,742,224 A * 5/1988 Chu et al. ..... 250/305
5,206,506 A 4/1993 Kirchner
5,455,418 A 10/1995 Hogan
5,723,813 A * 3/1998 Ito et al. ..... 174/28
5,769,996 A * 6/1998 McArdle et al. ..... 156/272.4
6,040,573 A 3/2000 Sporleder et al.
6,051,838 A * 4/2000 Frosien et al. ..... 250/396 R
6,114,692 A 9/2000 Beu
6,432,739 B1 * 8/2002 Gudesen et al. ..... 438/99
6,791,080 B2 9/2004 Doroshenko et al.
6,872,952 B2 3/2005 Shimada et al.
6,897,442 B2 5/2005 Petrov
7,038,216 B1 * 5/2006 Dahl et al. ..... 250/423 R
7,081,618 B2 7/2006 Laprade
7,223,969 B2 5/2007 Schultz et al.
7,259,369 B2 * 8/2007 Scott et al. ..... 250/287
7,292,749 B2 11/2007 Gluckstad et al.
7,309,859 B2 12/2007 Fischer et al.
7,455,758 B2 11/2008 Muller et al.
7,518,105 B2 4/2009 Dahl et al.
7,518,106 B2 4/2009 Dahl et al.

(Continued)

OTHER PUBLICATIONS

PCT International Search Report and Written Opinion of the International Searching Authority for PCT/US11/34644, dated Nov. 3, 2011, 12 pages.

(Continued)

*Primary Examiner* — David A Vanore
*Assistant Examiner* — Wyatt Stoffa
(74) *Attorney, Agent, or Firm* — TraskBritt

(57) ABSTRACT

Apparatuses and methods relating to generating an electric field are disclosed. An electric field generator may include a semiconductive material configured in a physical shape substantially different from a shape of an electric field to be generated thereby. The electric field is generated when a voltage drop exists across the semiconductive material. A method for generating an electric field may include applying a voltage to a shaped semiconductive material to generate a complex, substantially nonlinear electric field. The shape of the complex, substantially nonlinear electric field may be configured for directing charged particles to a desired location. Other apparatuses and methods are disclosed.

12 Claims, 14 Drawing Sheets

U.S. PATENT DOCUMENTS

| | | | | |
|---|---|---|---|---|
| 7,777,180 | B2 | 8/2010 | Hill, Jr. et al. | |
| 7,777,182 | B2 | 8/2010 | Dahl et al. | |
| 2001/0011702 | A1 | 8/2001 | Yonezawa et al. | |
| 2003/0062474 | A1* | 4/2003 | Baranov et al. | 250/288 |
| 2003/0142440 | A1* | 7/2003 | Clinton et al. | 360/123 |
| 2004/0142106 | A1 | 7/2004 | Mirkin et al. | |
| 2005/0061767 | A1 | 3/2005 | Pai et al. | |
| 2005/0155860 | A1* | 7/2005 | Palmieri | 204/450 |
| 2007/0040114 | A1 | 2/2007 | Malek | |
| 2007/0044580 | A1* | 3/2007 | Arcas et al. | 73/865.5 |
| 2009/0103185 | A1* | 4/2009 | Helwegen et al. | 359/666 |
| 2009/0294697 | A1* | 12/2009 | Katagiri et al. | 250/492.3 |
| 2010/0276588 | A1* | 11/2010 | Syms | 250/288 |
| 2011/0036978 | A1* | 2/2011 | Franzen | 250/283 |
| 2011/0266436 | A1* | 11/2011 | Scott et al. | 250/287 |
| 2012/0043460 | A1* | 2/2012 | Wouters et al. | 250/282 |

OTHER PUBLICATIONS

Lee et al., "Fabrication of Stable Metallic Patterns Embedded in Poly(dimethylsiloxane) and Model Applications in Non-Planar Electronic and Lab-on-a-Chip Device Patterning," Adv. Funct. Mater, 2005, 15, No. 4, April, pp. 557-566.

Appelhans et al., "Measurement of external ion injection and trapping efficiency in the ion trap mass spectrometer and comparison with a predictive model," International Journal of Mass Spectrometry 216 (2002) 269-284.

Dahl et al., "Comparison of ion trajectories in vacuum and viscous environments using SIMION: Insights for instrument design," International Journal of Mass Spectrometry 266 (2007) 156-165.

Lai et al., "The predictive power of SIMION/SDS simulation software for modeling ion mobility spectrometry instruments," International Journal of Mass Spectrometry 276 (2008) 1-8.

Peng et al., "Planar resistive electrode ion traps: A new tool for planetary atmosphere analysis," Lunar and Planetary Science XXXIX (2008), p. 2476.

Scott et al., "Noncontact measurement of electrostatic fields: Verification of modeled potentials within ion mobility spectrometer drift tube designs," Review of Scientific Instruments 78, 035110 (2007).

Tan et al., "Atmospheric Pressure MALDI with Pulsed Dynamic Focusing for High-Efficiency Transmission of Ions into a Mass Spectrometer," Anal. Chem. 2004, 76, 2462-2469.

Tang et al., "High-Sensitivity Ion Mobility Spectrometry/Mass Spectrometry Using Electrodynamic Ion Funnel Interfaces," Anal. Chem., 2005, 77, pp. 3330-3339.

Arisawa, S., et al., "Control of molecular orientations by a pulsating electric field applied to a monolayer at the air-water interface" Langmuir 1993, 1028-1030.

* cited by examiner

APPARATUSES AND METHODS FOR GENERATING ELECTRIC FIELDS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATION

The subject matter of the present application is related to U.S. application Ser. No. 13/096,823, filed Apr. 28, 2011, pending.

TECHNICAL FIELD

Embodiments of the present invention relate generally to generating an electric field and, more specifically, to apparatuses and methods for generating an electric field to direct movement of charged particles.

BACKGROUND

When evaluating the composition of a substance, it is often desirable to study the behavior of charged particles (e.g., ions, electrons) generated from a sample of the substance of interest. Charged particles are often discharged from the sample in the form of atomic or molecular ions; however, in some cases it may be desirable to study subatomic or larger (i.e., nanomaterial) particles bearing a charge.

Various types of instruments have been developed to facilitate the evaluation of charged particles, including, for example, ion mobility spectrometers, time of flight mass spectrometers, multi-pole mass spectrometers, and cyclotrons. Such instruments may be commonly used to detect explosives, narcotics, and chemical warfare (e.g., nerve and blister) agents. The instruments used to facilitate evaluation of the charged particle generally include the controlled generation of one or more electric fields. For example, some instruments may utilize electric fields to accelerate, separate, and otherwise selectively direct charged particles. Expanded application of charged particle analysis often entails the careful design of an electric field tailored with various predetermined characteristics. Examples of such predetermined characteristics may include the shape or focal points (i.e., the desired destination of the charged particles) of the electric field and the spatial orientation of the electric field relative to the desired pathway of charged particles within the instruments.

There are different approaches in generating electric fields for directing charged particles. One approach for an electric field generator is to apply different voltages to a plurality of conductive parts (sometimes called "lenses" or "conductive electrodes") spaced apart from each other. If a voltage is applied to the conductive electrodes, an electric field is generated. The voltages applied to a plurality of conductive electrodes combine to form the electric field. Certain complex electric fields (e.g., quadrupolar) have been generated by the arrangement of the plurality of conductive electrodes. Another approach for generating an electric field may include applying a voltage to an electrode formed from a semiconductive material, which semiconductive material is a simple shape (e.g., formed as a simple tube or plate) and uniform in resistivity in order to generate a simple (e.g., linear) electric field.

One factor that may influence properties of the electric field includes the orientation of the electrodes relative to each other. Conventionally, the resulting complex electric fields or simple electric fields are determined by, and substantially emulate (i.e., mirror) the shapes and configurations of the electrodes used to generate the electric field. For example, a linear electric field is generated conventionally using a cylindrical electrode or a rectangular bar (e.g., a linear drift tube). A quadrupolar electric field is generated conventionally using conductive electrodes configured in a physical shape that is substantially similar to the shape of the electric field (e.g., an ion trap). This conforming of the physical configuration of the electric field generator and the resulting electric field may reduce the flexibility of the shapes that are to be used to generate a given electric field, and therefore, may limit the shape and configuration of the device that may include the electric field generator.

FIG. 1A is a schematic depicting a conventional electric field generator 100. For example, the electric field generator 100 may be implemented as an interface for confining and releasing charged particles within an ion mobility spectrometer (not shown). The electric field generator 100 may include a plurality of conductive electrodes 110, 120, 125, 130, 135 and a voltage source 140. The conductive electrodes 110, 120, 125, 130, 135 may be fabricated from electrically conductive materials (e.g., metals and metal alloys). Specifically, the electric field generator 100 includes an outer electrode 110, and inner electrodes 120, 125 within the interior 105 of the electric field generator 100. The electric field generator 100 further includes end cap electrodes 130, 135. As shown in FIG. 1A, each end cap electrode 130, 135 may include a portion extending into the interior 105 of the electric field generator 100.

In operation, a voltage source 140 may be connected to the different conductive electrodes 110, 120, 125, 130, 135, such that an electric field is generated when a voltage is applied to one or more of the conductive electrodes 110, 120, 125, 130, 135 (see FIG. 1B). The voltage source 140 may provide voltages of the same voltage potential or voltages of a different voltage potential to each of the conductive electrodes 110, 120, 125, 130, 135, as the case may be. For example, the voltage source 140 may include a resistive ladder (not shown) configured to generate voltages 141-145 at different nodes between the individual resistors of the resistive ladder. Resistive ladders may require careful selection of components, each of which may fail separately or characteristics of which may change with temperature, which may lead to distortion of a desired electric field generated by the conductive electrodes 110, 120, 125, 130, 135. Alternatively, the voltage source 140 may include control logic to independently control the voltage level of voltages 141-145 according to voltage functions, which may control or alter the shape of the electric field depending on the relative strength of each voltage level of voltages 141-145.

FIG. 1B depicts a resulting electric field 150, which may be generated by the conventional electric field generator 100 of FIG. 1A. The electric field 150, as shown, may be a quadrupolar shape, which may be useful for confining charged particles in a given space. Conventionally, the quadrupolar shape of the electric field 150 substantially emulates (i.e., mirrors) the physical configuration of the electrodes 110, 120, 125, 130, 135 of FIG. 1A. Conventionally, quadrupolar electric fields may be generated by configuring the conductive electrodes of an electric field generator in hyperbolic shapes. For example, when the voltage source 140 applies a voltage to each of the electrodes 110, 120, 125, 130, 135, portions of the resulting electric field 150 can be seen to mimic the shape of the physical configuration as shown by the numerical indicators of FIG. 1B.

FIG. 2A is a cross-sectional view of a schematic of a conventional electric field generator 200. The conventional electric field generator 200 may be configured as a cylinder with an inner diameter 201 through which charged particles 206-208 may travel. The generated electric field 205 may be configured to direct the charged particles 206-208 through the cylinder. The conventional electric field generator 200 may include a plurality of conductive electrodes 210-216. Because each conductive electrode 210-216 may be at a different voltage potential, conductive electrodes 210-216 may need to be electrically isolated from each other. Regions 220-225 may provide the electrical isolation for conductive electrodes 210-216. Regions 220-225 may be voids (i.e., air), or may be insulators. One problem encountered with having a plurality of conductors 210-216 separated by regions 220-225 is that the interface between a conductive electrode (e.g., 210) and an adjacent region (e.g., 220) may create a ridge. Such a ridge may alter airflow across the surface of the conventional electric field generator 200. Such a turbulent airflow may reduce the effectiveness of the conventional electric field generator 200 in directing the charged particles 206-208. Additionally, when regions 220-225 include insulators that may be exposed to the charged particles 206-208, the insulators themselves may become charged, which may distort the electric field 205.

FIG. 2A also shows that the electric field 205 generated by conventional electric field generators 200, employing stacked conductive electrodes 210-216 and regions 220-225, may have nonlinear portions near the conductive electrodes 210-216 that may cause the charged particles 207, 208 located away from the center of the cylinder to drift toward the conductive electrodes 210-216. These nonlinear portions of the electric field 205 may cause the charged particles 207, 208 located off-center to contact the conductive electrodes 210-216 or to have an undesirably different path length in contrast with the charged particles 206 located near the center of the cylinder. This undesirably different path length may cause the charged particles 207, 208 to arrive at a desired location at a different time than charged particles 206.

FIG. 2B is a graph showing boundary voltages 230 along a conventional electric field generator such as, for example, the conventional electric field generator 200 of FIG. 2A. The boundary voltages 230 may generate an electric field 205, which, as shown by FIG. 2B may be pseudo-linear. For example, the conventional electric field generator 200 may experience a voltage drop between $V_H$ and $V_L$. For example, voltages $V_6$-$V_L$ may be applied to conductive electrodes 210-216, respectively. Conductive electrodes 210-216 may create discontinuities (i.e., gaps) in the resulting boundary voltages 230, which may distort the boundary voltages 230 from generating the desired electric field 205. For example, in an alternating stack of conductive electrodes 210-216 and regions 220-225 (e.g., insulators) therebetween, the boundary voltages 230 change across the regions 220-225, while the boundary voltages 230 are substantially flat across the conductive electrodes 210-216 because the voltage across a conductor is essentially constant. These discontinuities or "steps" may not be the desired effect for the electric field 205, yet the steps may not be avoided with conventional conductive electrodes 210-216. Because these discontinuities are more apparent near the surface of the conventional electric field generator 200, the discontinuities may be more exaggerated in applications that have a relatively small scale.

In general, the conductive electrodes 210-216 may cause the conventional electric field generator 200 to be relatively complicated to construct, as multiple conductive parts must be precisely positioned in relation to each other in order to obtain the desired electric field 205. In addition, electrodes 210-216 separated by insulators may be relatively heavy, which can be an issue for miniaturization or for aerospace applications.

FIG. 2C is a perspective view of a conventional electric field generator 250. The conventional electric field generator 250 may be configured as a generally elongate, cylindrically shaped member having a first end 255, a second end 260, and a length 270. The conventional electric field generator 250 may be formed from an electrically semiconductive material so that a voltage potential may be established along the axis of conventional electric field generator 250.

In operation, a voltage source (not shown) may provide voltages of different potentials to the first end 255 and the second end 260 of the conventional electric field generator 250, causing a voltage drop across the conventional electric field generator 250. A voltage drop across the conventional electric field generator 250 results in the generation of an electric field within an interior region of the conventional electric field generator 250.

FIG. 2D depicts a resulting electric field 275, which may be generated by the conventional electric field generator 250 of FIG. 2C. Conventionally, the resulting electric field 275 substantially emulates (i.e., mirrors) the physical shapes and configurations of the electrodes used to generate the electric field. For example, a linear electric field 275 is conventionally generated by a cylindrical electrode, such as with the generally elongate, cylindrically shaped member of the electric field generator 250 of FIG. 2C.

FIG. 3 is a schematic of a conventional charged particle guide 300. Charged particle guide 300 may approximate an inlet to a mass spectrometer, such as the LCQ FLEET™ Ion Trap, available from Thermo Fisher Scientific, Inc. of Waltham, Mass. The electric field 305 and direction of charged particles 306 shown in FIG. 3 is modeled with a statistical diffusion simulation (SDS) in the simulation software, SIMION®, which software is available from Scientific Instrument Services, Inc. of Ringoes, N.J. Other simulations shown herein may also be modeled in SIMION®.

Conventional charged particle guide 300 may be configured to direct charged particles 306 toward an aperture 335 defined by a structure 330, after which the charged particles 306 may be further analyzed, re-directed, or otherwise processed, as desired. For example, a conventional charged particle guide 300 may be implemented as part of a conduit, which may assist the transfer of charged particles 306 generated at a high-pressure region (e.g., atmospheric region) into a low-pressure region (e.g., vacuum region) of an instrument, such as a mass spectrometer.

Conventional charged particle guide 300 includes conductive electrode 310 configured for generating an electric field 305 when a voltage is applied to the conductive electrode 310 by a voltage source (not shown). The voltage of the conductive electrode 310 and the structure 330 may be substantially equal. As with other conventional electric field generators, the physical shape of the configuration of the conductive electrode 310 substantially emulates the shape of the electric field 305 generated by the conventional charged particle guide 300. The electric field 305 may be shaped to direct charged particles 306 generated by a charged particle source 350. The resulting electric field 305 between charged particle source 350 and conductive electrode 310 may be substantially linear with relatively small perturbations in the electric field 305 due to the shape of the structure 330 and the conductive electrode 310.

Because the electric field 305 shown in FIG. 3 is substantially linear, the electric field 305 generally provides a vertical force toward conductive electrode 310 such that the electric field 305 directs the charged particles 306 in a direction vertical from the starting location of the charged particle 306. As a result of the vertical force generated by the substantially linear electric field 305, the charged particles 306 that that are not directly lined up with the aperture 335 of the structure 330 will be directed to locations other than the desired location. A conventional charged particle guide 300 may additionally include introducing airflow through the conventional charged particle guide 300 to further assist the direction of the charged particles 306 toward the aperture 335 in addition to influence from the electric field 305. However, even with the airflow, a substantial quantity of charged particles 306 may not be directed properly to aperture 335 and "die" (i.e., are neutralized) upon contact with the surface of the charged particle guide 300.

Because the electric field 305 between conductive electrode 310 and charged particle source 350 may, at times, adversely affect the efficiency of charged particles 306 entering the aperture 335, another example of a conventional method for directing charged particles 306 may include pulsed dynamic focusing (PDF). With PDF, the voltage applied to charged particle source 350 is dynamically switched from a different voltage from the conductive electrode 310 to a voltage that is equal to the conductive electrode 310 at a timed delay after the charged particles 306 are generated by the charged particle source 350. With an equal voltage between the charged particle source 350 and the conductive electrode 310, the electric field 305 may enter into a null state, after which airflow may be the primary force acting on the charged particles 306 to direct the charged particles 306 to the desired location. In other words, the airflow alone may act to direct off-center charged particles 306 to approach the conductive electrode 310, without the electric field 305 applying a force that may adversely affect charged particles 306 that originate off-center from the aperture 335.

The inventors have appreciated that there is a need for different apparatuses and methods for generating electric fields that may be used to control the motion of charged particles, which may be combined with airflow. The different apparatuses and methods may address one or more of the problems encountered by conventional approaches.

BRIEF SUMMARY

An embodiment of the present invention includes an electric field generator. The electric field generator comprises a semiconductive material configured in a physical shape substantially different from a shape of an electric field to be generated thereby, the electric field being generated when a voltage drop exists across the semiconductive material.

Another embodiment of the present invention includes an electric field generator, comprising a semiconductive material configured in a physical shape to generate a complex, substantially nonlinear electric field when a voltage drop exists across at least a portion of the semiconductive material.

Another embodiment of the present invention includes an electric field generator, comprising a structure defining an aperture of a charged particle guide, the aperture configured to receive charged particles from a charged particle source. The electric field generator further comprises an electrode proximate to and electrically isolated from the structure. The voltage of the electrode is substantially the same voltage as the charged particle source and the voltage of the electrode is substantially different from a voltage of the structure. The electrode is configured for generating an electric field that directs charged particles located off-center from the aperture toward the center of the aperture of the charged particle guide.

Another embodiment of the present invention includes a method for generating an electric field. The method comprises generating a resulting electric field responsive to application of a voltage to a shaped semiconductive material of an electric field generator. The resulting electric field exhibits a substantially different shape than a physical shape of the shaped semiconductive material.

Yet another embodiment of the present invention includes a method for directing charged particles. The method comprises applying a voltage to a shaped semiconductive material to generate a complex, substantially nonlinear electric field, wherein a shape of the complex, substantially nonlinear electric field is configured for directing charged particles to a desired location.

DETAILED DESCRIPTION

Figure 1A:
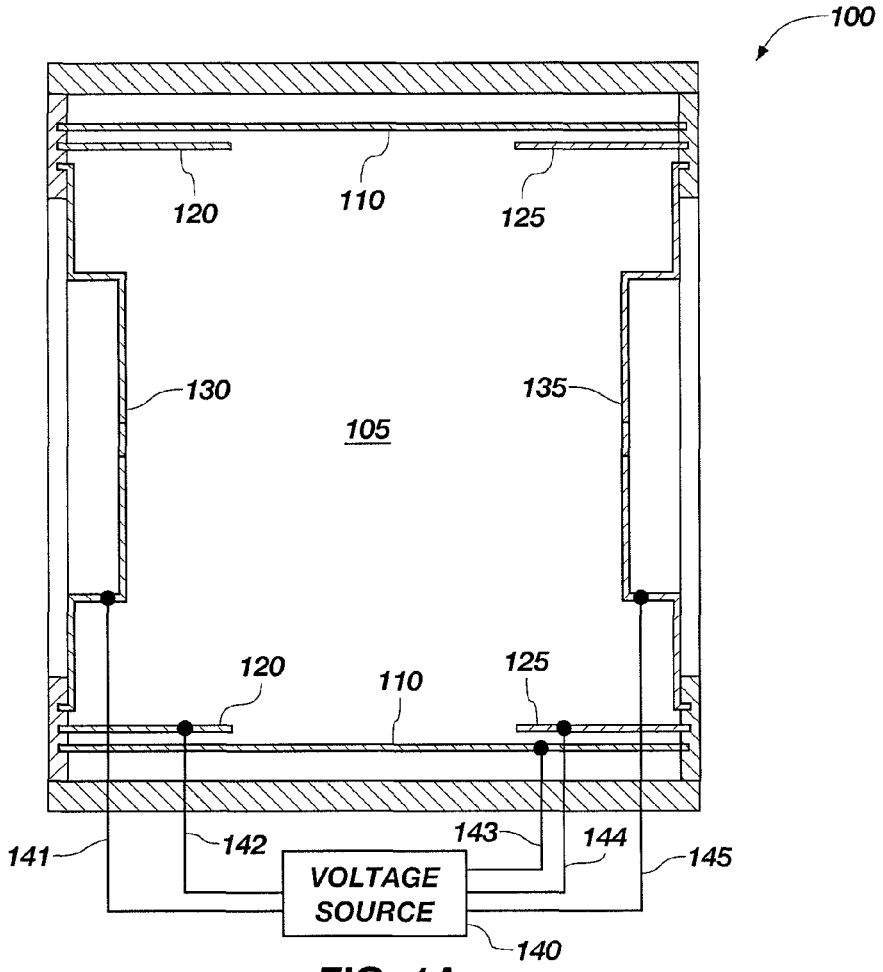
FIG. 1A (PRIOR ART)
FIG. 1A is a schematic depicting a conventional electric field generator.

In the following detailed description, reference is made to the accompanying drawings which form a part hereof and, in which is shown by way of illustration, specific embodiments in which the invention may be practiced. These embodiments are described in sufficient detail to enable those of ordinary skill in the art to practice the invention, and it is to be understood that other embodiments may be utilized, and that structural, logical, and electrical changes may be made within the scope of the disclosure.

In this description, specific implementations shown and described are only examples and should not be construed as the only way to implement the present invention unless specified otherwise herein. It will be readily apparent to one of ordinary skill in the art that the various embodiments of the present invention may be practiced by numerous other partitioning solutions.

Referring in general to the following description and accompanying drawings, various embodiments of the present invention are illustrated to show its structure and method of operation. Common elements of the illustrated embodiments may be designated with like reference numerals. It should be understood that the figures presented are not meant to be illustrative of actual views of any particular portion of the actual structure or method, but are merely idealized representations employed to more clearly and fully depict the present invention defined by the claims below.

Embodiments of the present invention relate to the generation of an electric field, including situations involving the movement and control of charged particles, such as ions or electrons. Embodiments of the present invention may be described herein as being applicable to instruments such as ion mobility spectrometers, mass spectrometers, and other devices that may analyze, or otherwise process charged particles. Embodiments of the present invention may also be applicable to charged particle guides, such as an ion funnel, which may be incorporated into such instruments, or otherwise control the direction of charged particles. However, embodiments of the present invention and application of embodiments of the present invention are not so limited.

As used herein, the term "electric field" refers to an electrostatic force per unit charge at points in space that may cause a charged particle to experience acceleration. The basic equation governing an electrostatic force (F) on the charged particle (p) is:

$$\overrightarrow{F_p(x,y,z)}=q_p\overrightarrow{E(x,y,z)} \quad (1),$$

where "E" is the electric field generated by the electric field generator, "q" is the charge on the charged particle (p), and the location of the charged particle (p) within the electric field is given in Cartesian coordinates x, y, and z. The units of the "electric field" are generally volts per meter. The terms "voltage," "potential," and "voltage potential," may be used interchangeably herein, which terms may refer to the measured voltage on a material or in space. Voltage is a scalar quantity and has units of volt.

It is recognized that in physics there may be distinctions between the terms "electric field," "electrostatic potential," and "electrostatic gradient." However, for purposes of this description, the term "electric field" is intended to be a general term that includes all of "electrostatic field," "electrostatic potential," and "electrostatic gradient," and in some cases these terms may, at times, be used interchangeably throughout this description. Thus, when electric fields, or equipotential lines representing an electric field, are described as being generated or altered to have a particular shape, focal point, or direction, one or more of the properties encompassed by any of the terms listed above may be affected.

A "simple" electric field refers to an electric field with a substantially linear shape. A material with a "simple" physical shape refers to a physical shape that has conventionally been used to generated a simple electric field (i.e., cylindrical, rectangular, plate-shaped). A "complex" electric field refers to an electrical field with a substantially nonlinear shape. A material with a "complex" shape refers to a shape that conventionally has been used to generate a complex electric field. Conventionally, complex electric fields have been generated by the use of multiple conductive electrodes configured in a complex shape, wherein the complex electric fields have emulated the physical shape of the conductive electrodes used for the generation thereof.

"Conductive" materials refer to materials that exhibit relatively high conductive properties, and in particular, refer specifically to metals and metal alloys. Conductive materials generally exhibit a substantially constant voltage throughout the material when a voltage is applied thereto. "Insulative" materials refer to materials that exhibit relatively low conductive properties such that very little, to no current flows therethrough. Insulative materials are generally used to electrically isolate materials charged with different voltage potentials. "Resistive" materials refer to materials that exhibit relatively low conductive properties, but have higher conductive properties than an insulator such that a resistive material may experience a relatively higher amount of current flowing therethrough. "Semiconductive" materials refer to materials that exhibit conductive properties between that of a conductor and a resistor. In industry, certain semiconductive materials may be labeled and sold as "conductive" (e.g., conductive polymer) or "resistive" (e.g., resistive polymer); however, for purposes of this application semiconductive materials may be considered as not being a conductive material as is defined herein (i.e., not a metal or a metal alloy). As a result, the line between semiconductive materials and resistive may not be so clear, and semiconductive materials and resistive materials may, at times, be used interchangeably in this application. Both semiconductive and resistive materials do not generally exhibit a substantially constant voltage throughout the material when a voltage differential is applied thereto.

In general, embodiments of the present invention may be formed from a variety of non-conductive materials (i.e., not metals or metal alloys). These non-conductive materials include semiconductive materials and resistive materials. Examples of semiconductive and resistive materials include graphite, ferrites, glass (e.g., lead glass), resistive foam, polymers, phenolic resins, epoxies, and other similar materials. An example of an epoxy is CONDUCTOBED™ carbon black filled conductive epoxy, which is available from SPI Supplies and Structure Probe, Inc. of West Chester, Pa.

Other semiconductive materials may include conductive fluids, such as a ferrofluid. Semiconductive materials may be suspended in a liquid (e.g., water, oil, alcohol, etc.) to form semiconductive materials employed in embodiments of the present invention. Other examples of semiconductive materials include materials used by the semiconductor industry, such as silicon, germanium and silicon carbide. The resistivity of such semiconductive materials may be altered by doping techniques, such as, for example, those doping techniques known in the semiconductor industry.

As will be described with reference to FIGS. 12A and 12B, semiconductive materials may be formed from a mixture of different combinations of conductive, semiconductive, resistive, and insulative materials. As will be described with reference to FIGS. 4, 10, 11, and 12A, embodiments of the present invention may also include one or more conductive components, which may comprise a metal or a metal-alloy.

Figure 4:
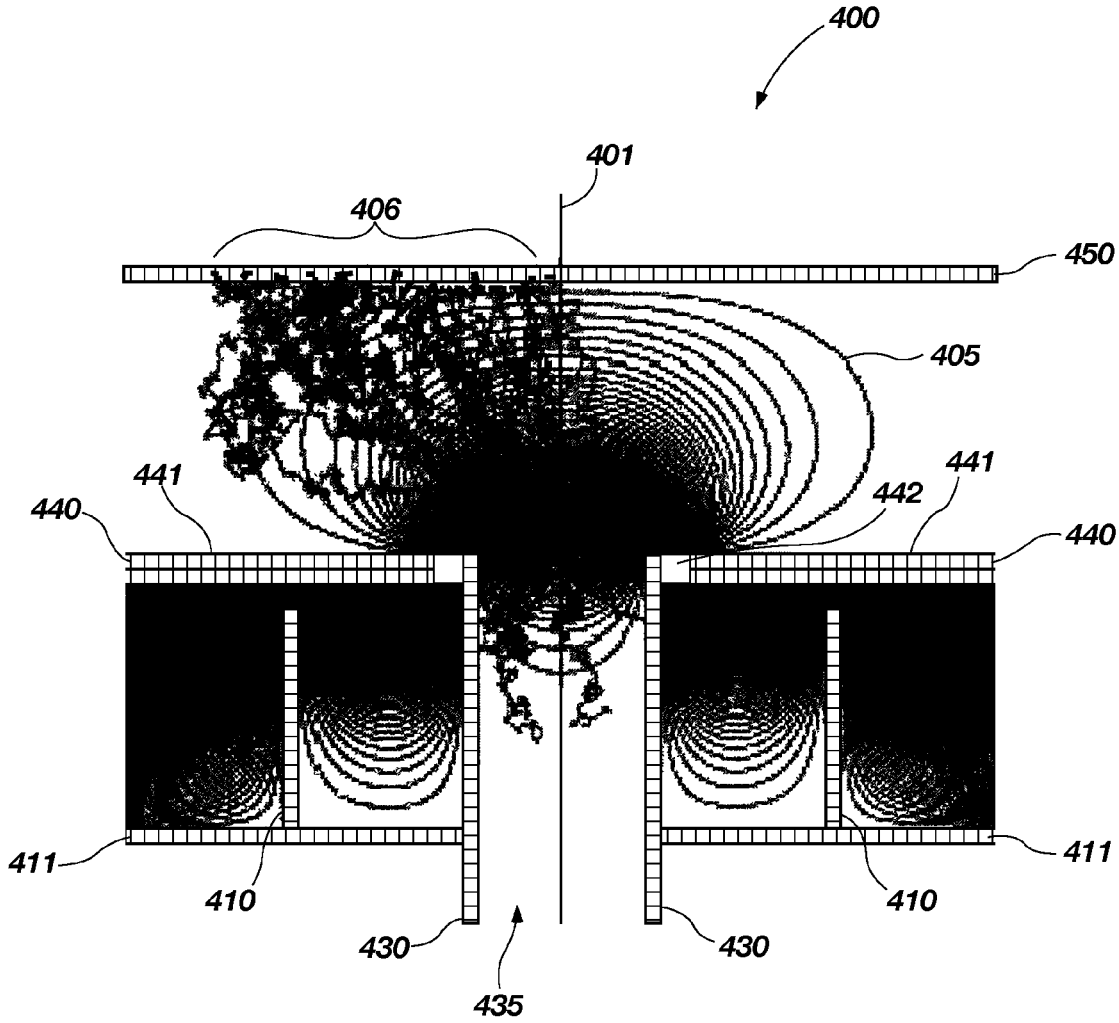
FIG. 4 is a schematic of a charged particle guide according to an embodiment of the present invention.

FIG. 4 is a schematic of a charged particle guide 400 according to an embodiment of the present invention. FIG. 4 may illustrate a cross-sectional view of a charged particle guide 400 that is formed as a disk, such that the components on the left side of the axis of symmetry 401 are the same as the components on the right side when rotated about the axis of symmetry 401. FIG. 4 may also illustrate a side view of a charged particle guide 400 that is rectangular in form such that the components on the left side of the axis of symmetry 401 are different from the components on the right side of the axis of symmetry 401.

One contemplated application for an electric field generator is within, or in conjunction with, a charged particle guide 400. An example of a charged particle guide 400 is an ion funnel. Charged particle guide 400 may be configured such that the electric field 405 has a force that includes a funnel effect on charged particles 406, in contrast with conventional ion funnels that rely primarily on mechanical components of an ion funnel to form a physical funnel. Charged particle guides 400 may be used for transferring charged particles 406 from a high-pressure region (e.g., the earth's atmosphere, a partial vacuum, an extraterrestrial atmosphere, or other similar region) into a low-pressure region (e.g., a vacuum chamber). For example, charged particles may be generated by a charged particle source 450 at atmospheric pressure. The low-pressure region may be part of an instrument for performing analysis of the charged particles 406. Examples of such instruments include mass spectrometers or some other instrument for analyzing or otherwise processing charged particles. Other instruments, such as ion mobility spectrometers, may perform analysis or processing at relatively higher pressures.

The charged particle source 450 may include devices that are configured to employ methods (e.g., by a laser desorption/ionization (LDI) event, by electro-spray ionization (ESI), by nuclear radiation, or other methods as would be apparent to those of ordinary skill in the art) for generating (i.e., creating) charged particles 406. The charged particle source 450 includes one or more electrodes for generating an electric field. Therefore, the charged particle source 450 may have a voltage potential and be configured as a repeller, or have a repeller associated with the charged particle source 450. Such a repeller may provide the charged particles 406 with momentum toward the aperture 435 before diffusion causes the charged particles 406 to expand too greatly. If the charged particles 406 expand to a relatively large volume, many of the charged particles 406 may not pass through the aperture 435, which may result in the charged particles 406 becoming lost from the analysis or other processing performed by the instrument.

Charged particle guide 400 includes electrode 440 configured to generate an electric field 405 when a voltage is applied thereto. The electrode 440 may extend in a direction orthogonal to the direction a structure 430 defining an aperture 435, into which the electric field 405 may direct charged particles 406 generated from a charged particle source 450. The structure 430 may be any structure defining an aperture, including a capillary member, to which charged particles 406 may be directed. Such a structure 430 may include slits, slots, or any combination thereof.

Electrode 440 may also form a surface 441 of charged particle guide 400. The electrode 440 may comprise a conductive or semiconductive material. The voltages of the structure 430 and the electrode 440 may be different. Thus, the electrode 440 may be electrically isolated from the structure 430 by a region 442. The region 442 may be a void (i.e., air), or may be formed from a material that may at least partially electrically isolate the electrode 440 from the structure 430. For example, region 442 may include a semiconductive material or an insulative material, keeping in mind that employing insulative materials may experience one or more of the issues associated with having insulators exposed to charged particles 406.

The relative voltages between the charged particle source 450 and the structure 430 may determine which polarity of charged particles 406 to be directed to the aperture 435. For example, if the charged particle source 450 has a more positive voltage than structure 430, charged particles 406 of a positive polarity may be directed toward the aperture 435. If the charged particle source 450 has a more negative voltage than the voltage of structure 430, the charged particles 406 of a negative polarity may be directed toward the aperture 435.

Electrode 440 may be proximate the opening of the aperture 435, and when configured as a disk, the electrode 440 may be placed around the aperture 435. Electrode 440 may be configured to alter the shape of the electric field 405 generated by the charged particle guide 400. For example, the equipotential lines representing the electric field 405 extend from one side of the structure 430 to the other side of the structure 430, and the concavity of the equipotential lines of the electric field 405 is directed toward the aperture 435. As a result, the equipotential lines representing the electric field 405 may be substantially spherical about the entry point to the aperture 435. In other words, the focal point of the electric field 405 is directed toward the entrance of aperture 435. In order to achieve the described electric field 405, the voltage of the electrode 440 may be approximately equal to the voltage of the charged particle source 450, which voltage may be different from the voltage of the structure 430.

Figure 3:
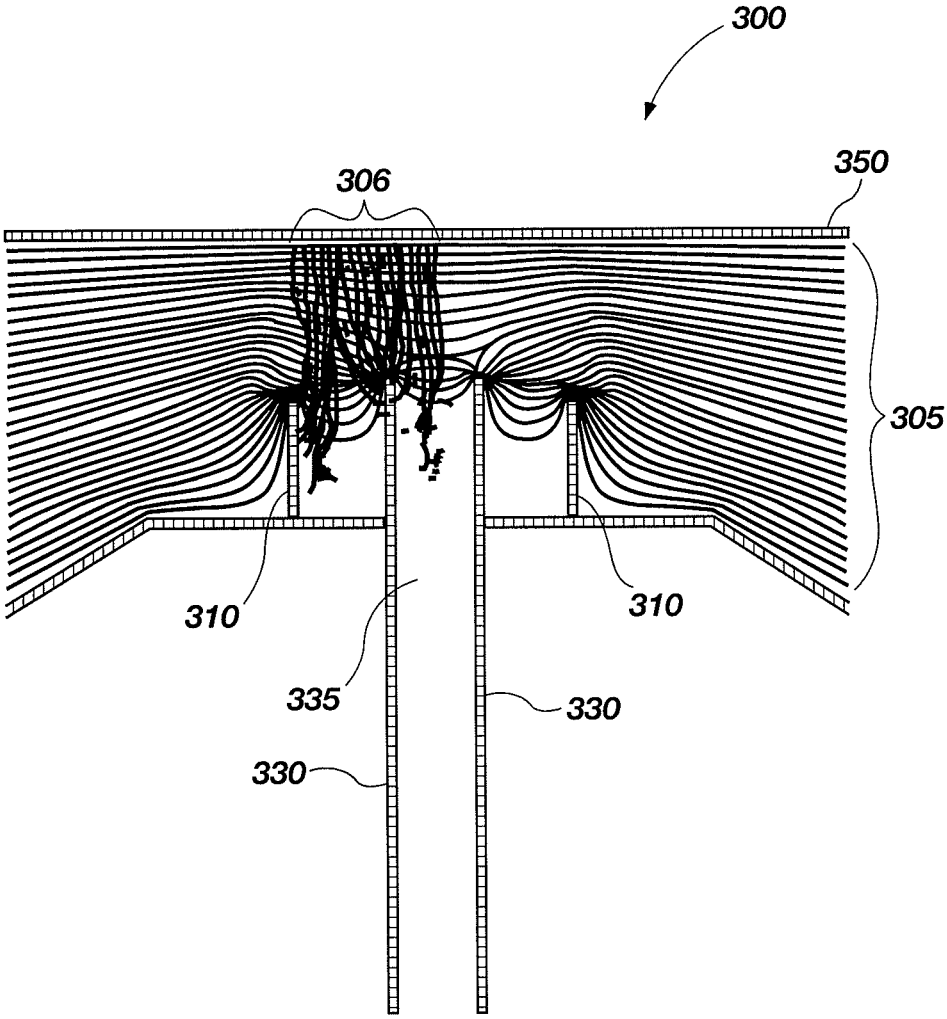
FIG. 3 (PRIOR ART)
FIG. 3 is a schematic of a conventional charged particle guide.

Such an electric field 405 may further improve directing the charged particles 406 toward the aperture 435 in comparison to conventional charged particle guides that include an electric field that tends to direct charged particles in a substantially vertical direction rather than toward the center of the aperture 435. It is noted that due to the density of the equipotential lines representing the electric field 405 near the aperture 435, the path of the charged particles 406 near the aperture 435 may be somewhat unclear. However, it is apparent in FIG. 4 that electric field 405 causes the charged particles 406 that begin off-center from the aperture 435 to be directed toward the aperture 435, and that a relatively lesser quantity of charged particles 406 are directed to the electrodes 440, 410 or to the wall of the structure 430, which is in contrast with the charged particle guide 300 of FIG. 3.

Thus, a funneling effect for the charged particles 406 may be generated primarily with the shape and forces of the electric field 405 rather than through having the physical shape of the charged particle guide 400 be a funnel shape. Charged particle guide 400 may further include introducing airflow across the surface 441 in order to further assist directing charged particles 406 toward the aperture 435 in addition to the direction provided by the electric field 405.

Thus, embodiments of the present invention may mitigate or eliminate the need to turn off the electric field 405 in order to allow airflow to be the primary force in directing charged particles 406 toward the center of the aperture 435. Mitigating or eliminating the need to turn off the electric field 405 may reduce the complexity of system electronics. Of course, one skilled in the art will recognize that embodiments of the present invention may include introducing airflow for assisting the electric field 405 in directing charged particles 406 toward the aperture 435. Additionally, embodiments of the present invention may further be configured as described herein, and have the electric field 405 at least temporarily turned off while directing charged particles 406 toward the center of the aperture 435.

Charged particle guide 400 may further include electrode 410 configured to contribute to the generated electric field 405 when a voltage is applied to the electrode 410. The electrode 410 extends from a first surface 411 of the charged particle guide 400 in a direction parallel to the structure 430. The electrode 410 may include a voltage substantially the same as the voltage of the structure 430.

Figure 5A:
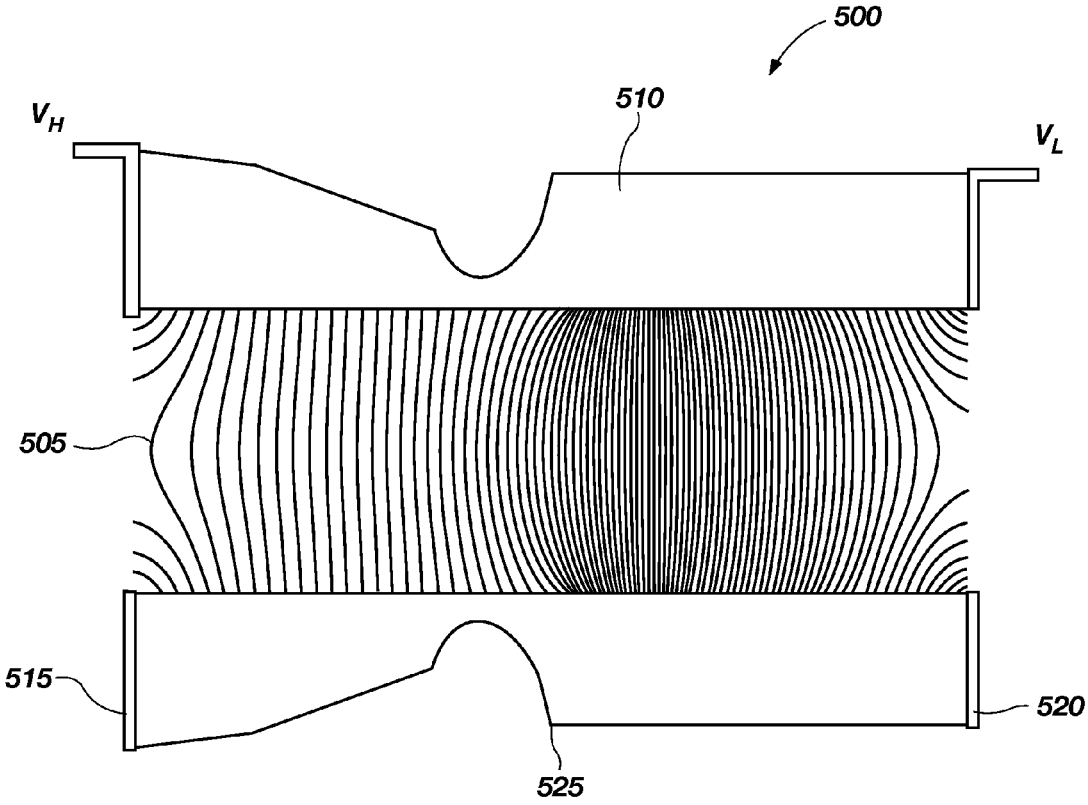
FIG. 5A is side view of an electric field generator according to an embodiment of the present invention.

FIG. 5A is side view of an electric field generator 500 according to an embodiment of the present invention. Electric field generator 500 is formed from a semiconductive material 510 that is configured to generate an electric field 505 when a voltage source (not shown) applies a voltage to the electric field generator 500. In other words, the electric field 505 is generated when a voltage drop (e.g., from $V_H$ to $V_L$) exists across the semiconductive material 510. For example, semiconductive material 510 includes a first end 515 with a lower voltage ($V_L$) and a second end 520 with a higher voltage ($V_H$).

Because an electrode formed from semiconductive material 510 is not necessarily a set of discrete parts, such as with conventional conductive electrodes, the generated electric field 505 may be substantially continuous. The semiconductive material 510 of the electric field generator 500 may be shaped in a non-conventional shape in order to generate a complex electric field 505. Whereas the resulting electric field of conventional electric field generators emulates the shape of the corresponding electric field generator, the semiconductive material 510 may be configured in a physical shape substantially different from the shape of a generated electric field 505.

The shape of the electric field 505 may depend on the voltages applied to the semiconductive material 510, and the resistivity of the semiconductive material 510. The resistance at a given point of the semiconductive material 510 may be defined as:

$$\text{Resistance}=(\text{Resistivity}*\text{Length})/\text{Surface Area} \quad (2)$$

Therefore, to consider the voltage at a given point along the surface of the semiconductive material 510, the semiconductive material 510 may be thought of as a voltage divider with an infinite number of points. Assuming that the resistivity of the semiconductive material 510 is uniform (i.e., homogenous resistivity), the voltage equation for such a voltage divider can be simplified to be:

$$V(l) = (V_H - V_l)\frac{\int_0^l \frac{dx}{A(x)}}{\int_0^f \frac{dx}{A(x)}} + V_l, \quad (3)$$

where "1" is the point where the voltage is to be measured, "f" is the final point of the semiconductive material 510, "$V_H$" is the upper voltage, "$V_1$" is the lower voltage for the voltage drop over semiconductive material 510, "dx" is the length, and "A(x)" is the surface area. The numerator of equation (3) represents the integration of the reciprocal of the cross-sectional area of the semiconductive material 510 up to the point "1" where the voltage V(1) is to be measured. The denominator of equation (3) represents the integration of the reciprocal of the cross-sectional area of the entire semiconductive material 510. In other words, if the numerator and denominators were multiplied by the resistivity, the numerator would represent the bulk resistance between "0" and "1," and the denominator would represent the bulk resistance between "0" and "f." However, it is noted that equation (3) has been simplified, such that the resistivity constant was able to be canceled out in both the numerator and the denominator, because the resistivity in this example is assumed to be homogeneous throughout the semiconductive material 510. Thus, the voltage drop over a semiconductive material 510 can be altered by shaping the semiconductive material 510 (i.e., altering the cross-sectional area) to form a complex shape (e.g., between the first end 515 and position 525).

Figure 5B:
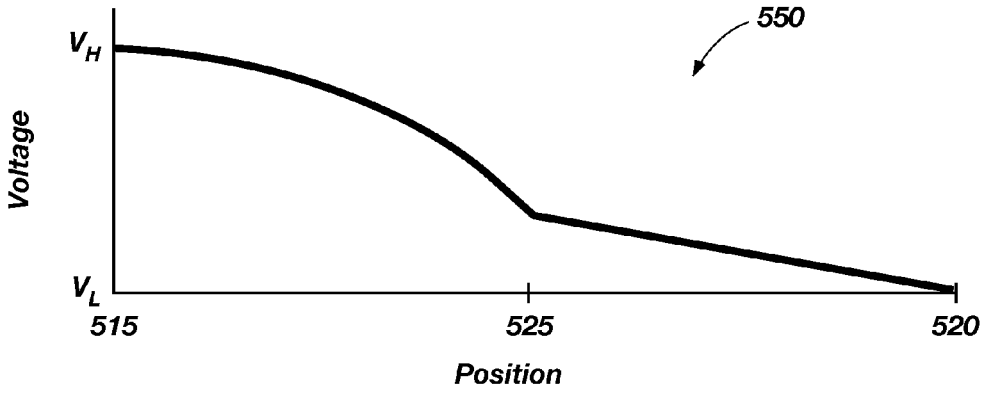
FIG. 5B is a graph depicting a voltage experienced at points along a length of the electric field generator of FIG. 5A.

FIG. 5B is a graph 550 depicting the voltage experienced at points along the length of the electric field generator 500 of FIG. 5A. The graph 550 shows that the voltage drop along the length of the electric field generator 500 is complex (i.e., nonlinear) between first end 515 and position 525. This nonlinear voltage drop across the electric field generator 500 may generate a complex electric field 505. In other words, an electric field 505 can be generated and altered by applying a voltage to semiconductive material 510 that is shaped in a manner to produce the desired electric field. A complex electric field, therefore, may not necessarily emulate the physical shape of the electric field generator 500. Additionally, even simple electric fields can be generated by electric field generators of a substantially dissimilar physical shape (e.g., linear electric fields generated by electric field generators that are shapes other than cylinders or rectangular bars).

The electric field 505 may be generated by the semiconductive material 510 with as few as two electrical connections, as opposed to numerous electrical connections needed for the multiple conductive electrodes in conventional practice. The semiconductive material 510 may also implemented without exposed insulators. Furthermore, the semiconductive material 510 may be manufactured to produce smooth surfaces for desirable laminar airflow conditions or other surface conditions for trapping uncharged particles (i.e., neutrals).

Figure 6A:
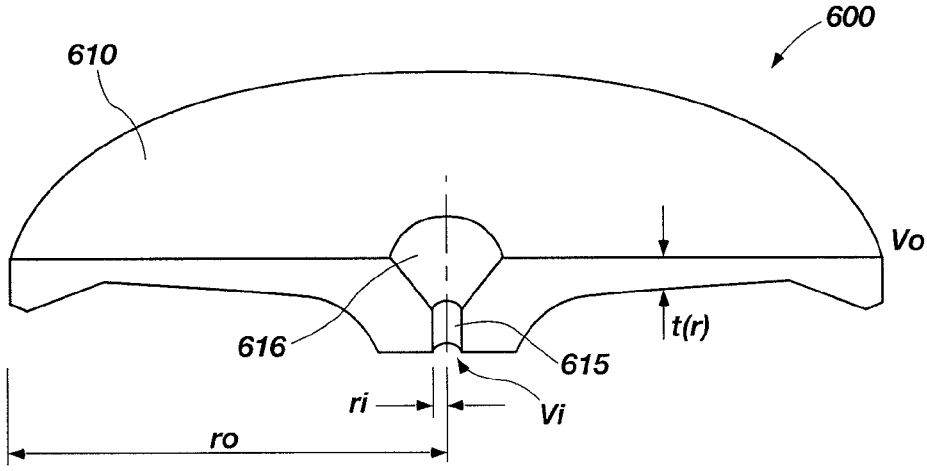
FIG. 6A is a cross-sectional view of an electric field generator according to an embodiment of the present invention.

FIG. 6A is a cross-sectional view of an electric field generator 600 according to an embodiment of the present invention. Electric field generator 600 is configured as an annular disk with an aperture 615. The aperture 615 may be configured to receive charged particles. The aperture 615 may align with an instrument that may further process and analyze the charged particles, or both. Although many of the examples of electric field generators are shown that include an aperture to which charged particles are directed; however, embodiments are not so limited. Some embodiments of the present invention may include electric field generators without an aperture, and may be configured to direct charged particles to a different location or focal point. Referring again to FIG. 6A, the aperture 615 may include a sloped portion 616, which may act as a physical funnel to combine with an airflow to collect the charged particles into the aperture 615.

The voltage of a given point (rd) along a diameter of the disk-shaped electric field generator 600 can be determined as:

$$V(rd) = Vi - \frac{\int_{ri}^{rd} \frac{1}{t(r)r} dr}{\int_{ri}^{ro} \frac{1}{t(r)r} dr}(Vi - Vo), \quad (4)$$

where "Vo" is the outer voltage, "Vi" is the inner voltage, "ro" is the outer radius, "ri" is the inner radius, and "t(r)" is the thickness. As in the case of equation (3) related to the electric field generator 500 of FIG. 5A, the numerator in equation (4) represents the reciprocal of the surface area (t(r)r) of the semiconductive material 610 integrated from the inner radius (ri) up to the radius for point (rd) where the voltage V(rd) is to be measured. The denominator of equation (4) represents the reciprocal of the surface area (t(r)r) integrated over the radius from inner radius (ri) to the outer radius (ro) of the entire semiconductive material 610.

If multiplied by the resistivity over (i.e., divided by) $2\pi$, the integral in the numerator represents the resistance measured from inner radius (ri) to radius (rd), and the integral in the denominator represents the resistance measured from inner radius (ri) to outer radius (ro) (i.e., the entire semiconductive material). However, because resistivity is assumed to be a uniform constant over the semiconductive material 610, the resistivity in the denominator cancels out with the resistivity in the numerator to arrive at simplified equation (4). In other words, the voltage drop over a semiconductive material 610 can be altered by shaping the semiconductive material 610 in a complex shape.

Figure 6B:
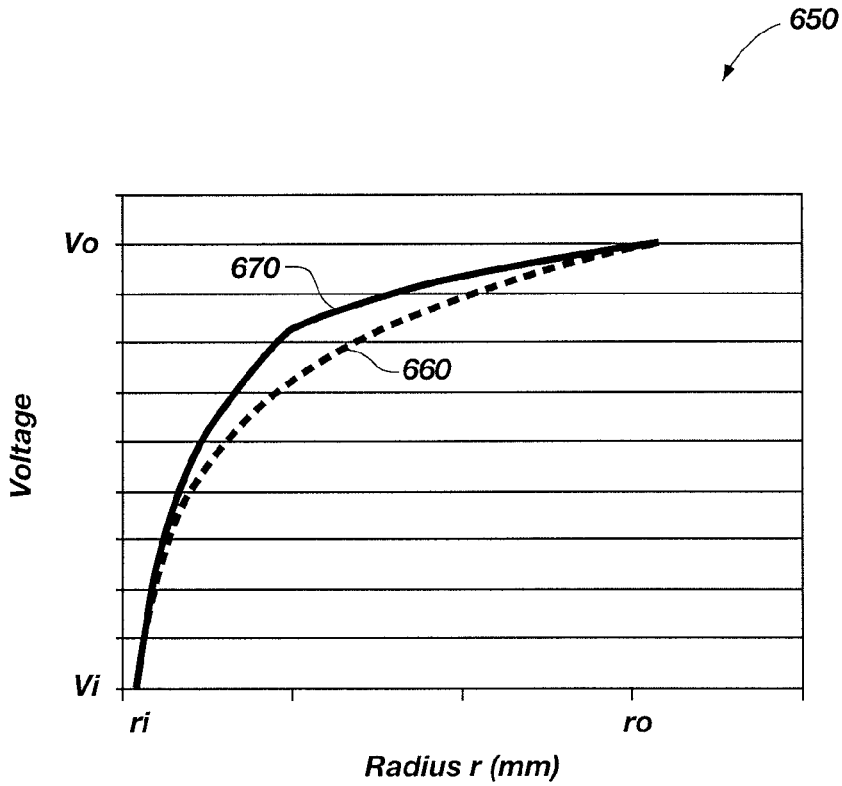
FIG. 6B is a graph depicting a voltage experienced at points along a radius of the electric field generator of FIG. 6A.

FIG. 6B is a graph 650 depicting the voltage experienced at points along the radius of the electric field generator 600 of FIG. 6A. The graph 650 shows that the voltage drop along the length of the electric field generator 600 is complex (i.e., nonlinear). This nonlinear voltage drop may generate a complex electric field around the electric field generator 600. The bottom line 660 of graph 650 represents the voltage experienced at points along the radius of the electric field generator 600 when the thickness t(r) is uniform from the inner radius (ri) to the outer radius (ro). The upper line 670 of graph 650 represents the voltage experienced at points along the radius of the electric field generator 600 when the thickness t(r) is not uniform from the inner radius (ri) to the outer radius (ro), which case is shown in FIG. 6A. In other words, the voltage drop and electric field of the electric field generator 600 can be further altered by altering the surface area of the semiconductive material 610, which may be accomplished by varying the thickness of the semiconductive material 610. For example, less thickness t(r) translates to less surface area, which causes more resistance and a greater voltage drop over the thinner region. The greater voltage drop contributes to the shape of the electric field generated by the electric field generator 600.

Figure 7:
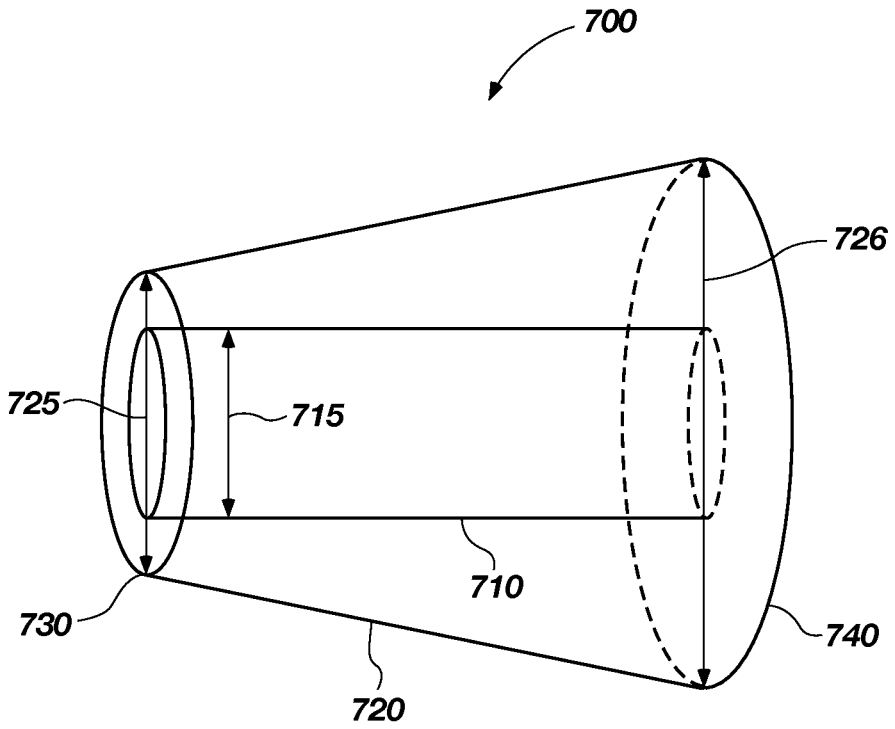
FIG. 7 is a schematic of an electric field generator according to an embodiment of the present invention.

FIG. 7 is a schematic of an electric field generator 700 according to an embodiment of the present invention. The electric field generator 700 includes an inner cylinder 710 with a constant inner diameter 715, and an outer portion 720 with a varying outer diameter 725, 726. If a voltage is applied to the electric field generator 700 such that a voltage drop exists from one end 730 (e.g., higher voltage) and the other end 740 (e.g., a lower voltage), a resulting complex electric field may be generated inside the inner cylinder 710 due to the varying thickness of the outer portion 720 of the electric field generator 700. It is, therefore, contemplated that altering the shape of the electric field (not shown) generated by the electric field generator 700 may be accomplished by altering the outer diameter (e.g., 725, 726) of the outer portion 720 while maintaining a constant inner diameter 715 of the inner cylinder 710. Thus, the thickness of the semiconductive material between the outer portion 720 and the inner cylinder 710 may be altered in order to generate a different electrical field. Referring again to equation (2) above, the resistance, and therefore also the shape of the electric field, varies with thickness (which affects the surface area) of the semiconductive material. As a result, an electric field may be generated that produces a nonlinear progression of the electric field down a cylinder with a constant inner diameter, which electric field may be configured to focus charged particles away from the inner walls of the cylinder and more toward the center of the inner cylinder 710.

Figure 8A:
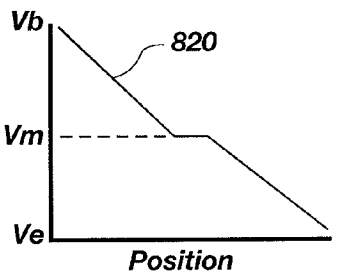
FIGS. 8A-8C are schematic views of various configurations of electric field generators, which may be employed for generating an electric field that directs charged particles toward an aperture.
Figure 8A:
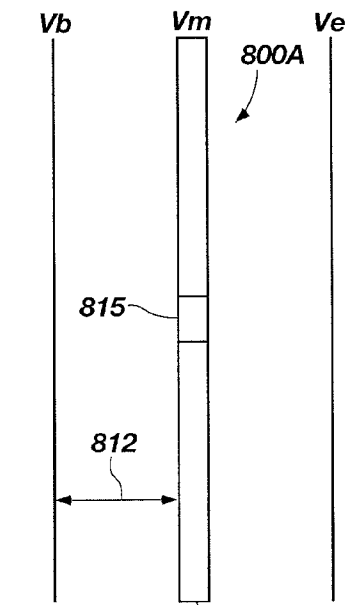
Figure 8B:
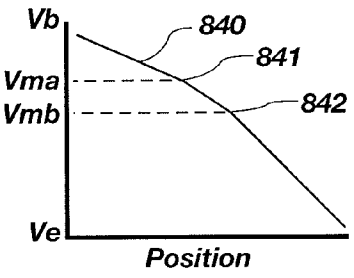
Figure 8B:
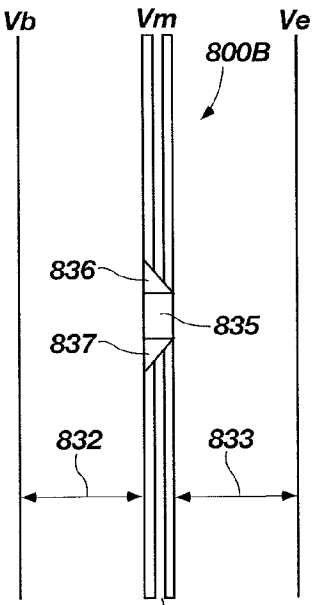
Figure 8C:
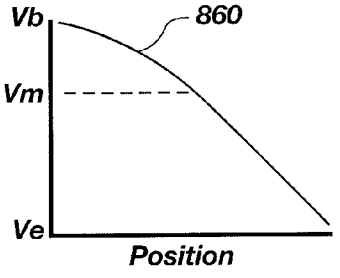
Figure 8C:
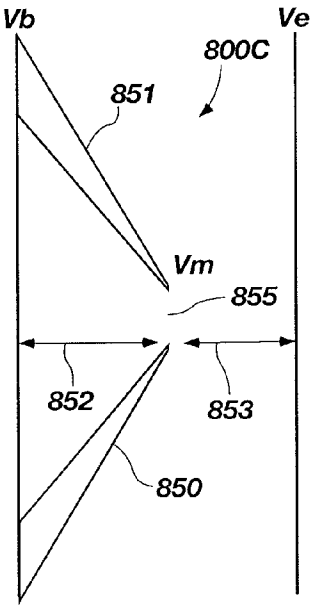

FIGS. 8A-8C are schematic views of various configurations of electric field generators 800A, 800B, 800C, which may be configured for generating an electric field that directs charged particles, such as toward an aperture 815, 835, 855. Illustrated above each of the electric field generators 800A, 800B, 800C is a two-dimensional representation of the centerline voltages 820, 840, 860 of the electric field generated by the respective electric field generators 800A, 800B, and 800C.

FIGS. 8A-8C each depict an electric field generator 800A-800C for generating a resulting electric field including a respective centerline voltages 820, 840, 860. The graphs of centerline voltages 820, 840, 860 represent the voltage potentials for the electric fields generated by the electric field generators 800A-800C, wherein such centerline voltages 820, 840, 860 are estimated along a centerline (not shown) through the space between voltages Vb and Ve through the center of the respective apertures 815, 835, 855. For example, in FIG. 8A, the centerline voltage 820 is shown for points along a straight centerline (not shown) starting at voltage Vb and extending through the center of aperture 815 to voltage Ve. In each of these examples (FIGS. 8A-8C), an electric field is generated such that Vb is a voltage on one side of the apertures 815, 835, 855 where charged particles originate and Ve is a voltage on the other side of the apertures 815, 835, 855 where charged particles have passed through the apertures 815, 835, 855. For example, Vb may be the voltage of the charged particle source and Ve may be the voltage of the instrument that processes the charged particles.

Figure 1B:
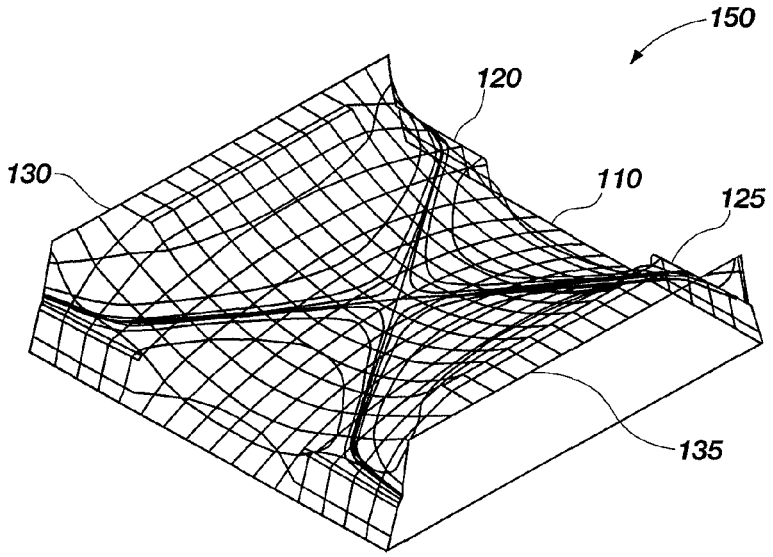
FIG. 1B (PRIOR ART)
FIG. 1B depicts a resulting electric field, which may be generated by the conventional electric field generator of FIG. 1A.
Figure 2A:
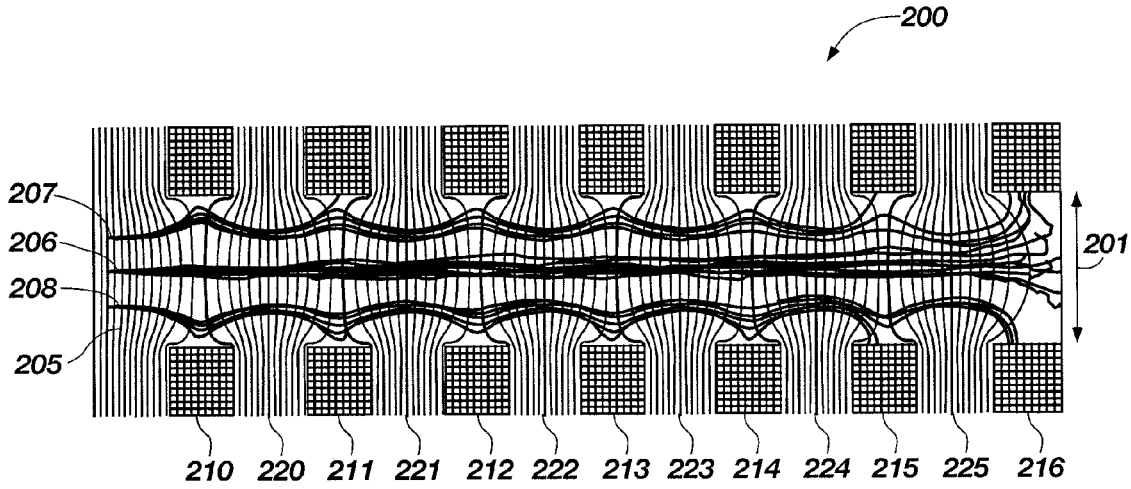
FIG. 2A (PRIOR ART)
FIG. 2A is a schematic of a conventional electric field generator.
Figure 2B:
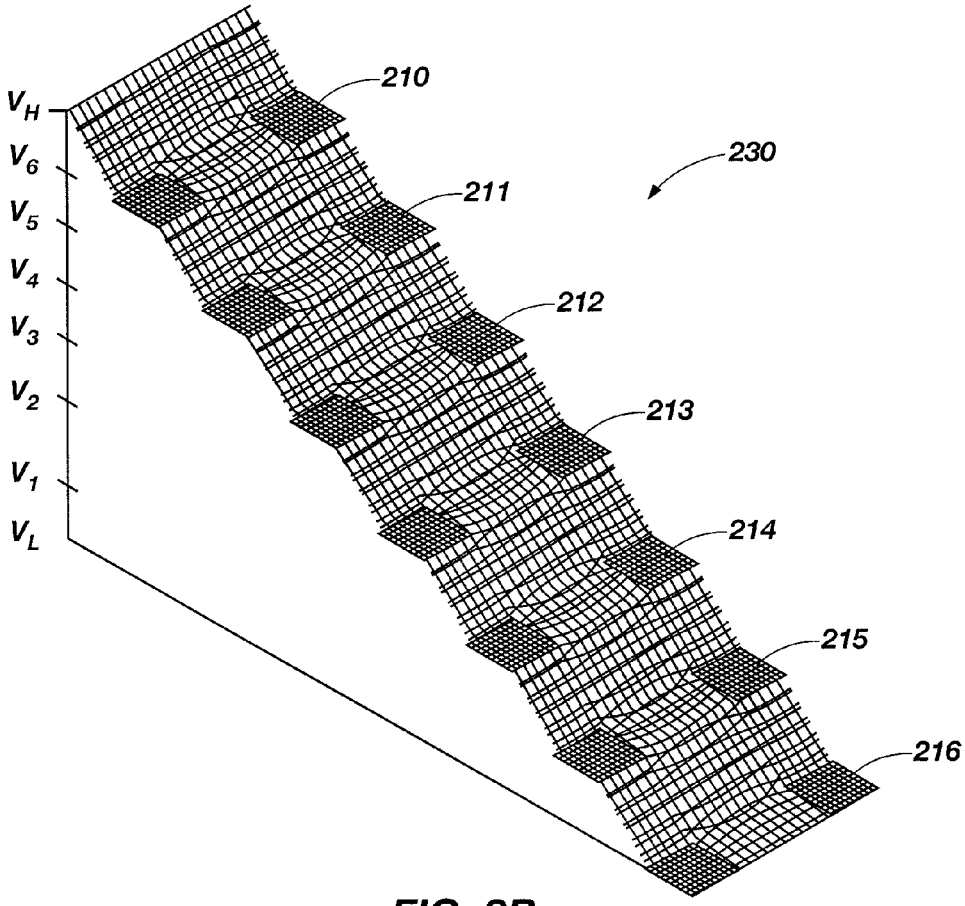
FIG. 2B (PRIOR ART)
FIG. 2B depicts a resulting electric field, which may be generated by the conventional electric field generator of FIG. 2A.
Figure 2C:
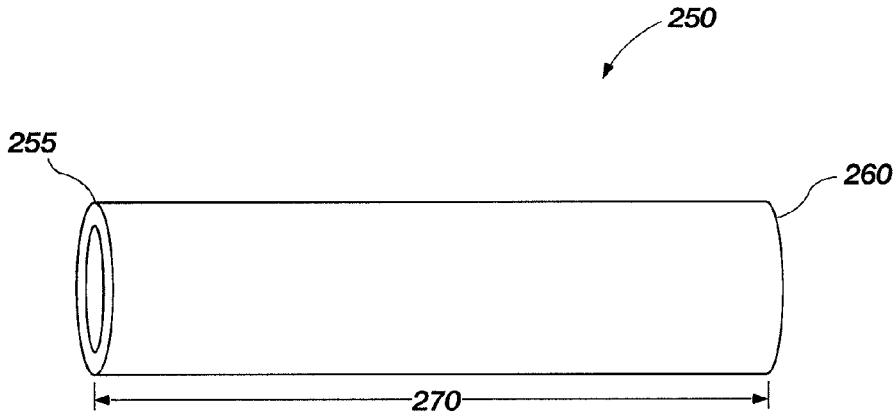
FIG. 2C (PRIOR ART)
FIG. 2C is a perspective view of a conventional electric field generator.
Figure 2D:
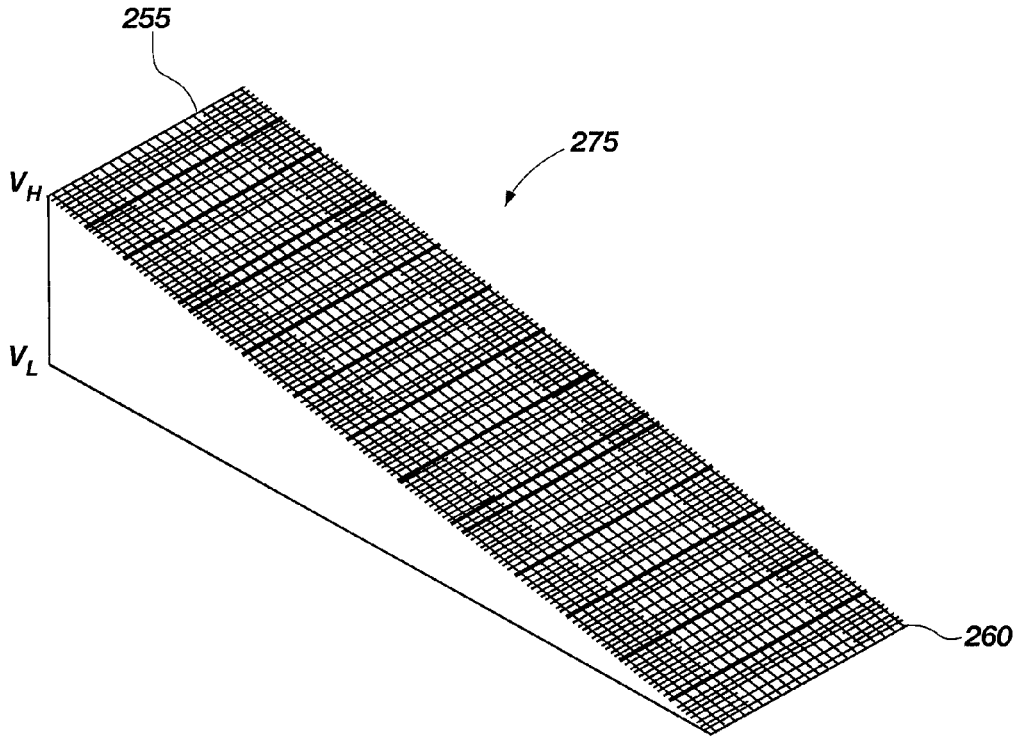
FIG. 2D (PRIOR ART)
FIG. 2D depicts a resulting electric field, which may be generated by the conventional electric field generator of FIG. 2C.

Referring specifically to FIG. 8A, the electric field generator 800A may be a conventional configuration of an electric field generator. As discussed with respect to FIGS. 1A and 3, such a conventional electric field generator 800A may be formed from conductive electrodes 810 and insulators. At least some of the problems and disadvantages that may be associated with conventional electric field generators (including 800A) have been described with respect to FIGS. 1 through 3.

Conventional electric field generator 800A may tend to direct the charged particles to the edges of the aperture 815 rather than the center of the aperture 815 itself. Generally, a relatively steep slope in the centerline voltage 820 moving toward the aperture 815 followed by a flatter slope in centerline voltage 820 through the aperture 815 encourages charged particles to be directed to the sides of the aperture 815 rather than the center of the aperture 815. For example, a relatively steep slope in the centerline voltage 820 from a distance 812 prior to the aperture 815 followed by a constant voltage Vm at the aperture 815 tends to direct the charged particles to the sides of the aperture 815 rather than the center of the aperture 815. The constant voltage Vm at the aperture 815 is caused by a constant voltage of conductive electrode 810 defining the aperture 815.

FIG. 8B depicts an electric field generator 800B with a resulting centerline voltage 840 according to an embodiment of the present invention. Electric field generator 800B includes conductive electrode 810, coupled with portions of semiconductive materials 836 and 837, such that the ends of semiconductive materials 836 and 837 have voltages Vma and Vmb. As the distance 832 moves closer to the aperture 835, the centerline voltage 840 changes from voltage Vb to voltage Vma. Through the aperture 835, the centerline voltage 840 changes from voltage Vma to voltage Vmb in a gradual manner rather than having a constant voltage through the aperture 835, as was shown by FIG. 8A. As the distance 833 moves from the aperture 835, the centerline voltage 840 changes from voltage Vmb to voltage Ve.

Generally, a relatively flatter slope for the centerline voltage 840 prior to the aperture 835 followed by a relatively steeper slope for the centerline voltage 840 yields an electric field about the aperture 835 that encourages charged particles to be directed to the center of the aperture 835 rather than the edge of the aperture 835. Thus, the shape of an electric field 840 in FIG. 8B tends to direct charged particles more toward the center of the aperture 835 rather than the sides of the aperture 835. The conductive electrodes 830, 831 may cause inflection points 841, 842 in the centerline voltage 840 of the electric field, which may create some discontinuity in the slope of the resulting centerline voltage 840.

FIG. 8C depicts an electric field generator 800C with a resulting centerline voltage 860 according to an embodiment of the present invention. Electric field generator 800C includes semiconductive materials 850 and 851, with a voltage applied thereto such that the semiconductive materials 850 and 851 experience a voltage drop between voltage Vb and voltage Vm. As the distance 852 moves closer to the aperture 855, the centerline voltage 860 changes from voltage Vb to voltage Vm in a relatively gradual manner rather than having a constant voltage through the aperture 835, as was shown by FIG. 8A. As the distance 853 moves from the aperture 855, the centerline voltage 860 moves from voltage Vm to voltage Ve. As in the case of FIG. 8B, the shape of the slope of the centerline voltage 860 in FIG. 8C tends to direct charged particles more toward the center of the aperture 855 rather than the sides of the aperture 835. The gradual continuous voltage change in the centerline voltage 860 of the electric field caused by the semiconductive materials 850, 851 may reduce the effects of inflection points in the centerline voltage 860 of the electric field, if any exist at all, which may generate a relatively more continuous centerline voltage 860.

Figure 9A:
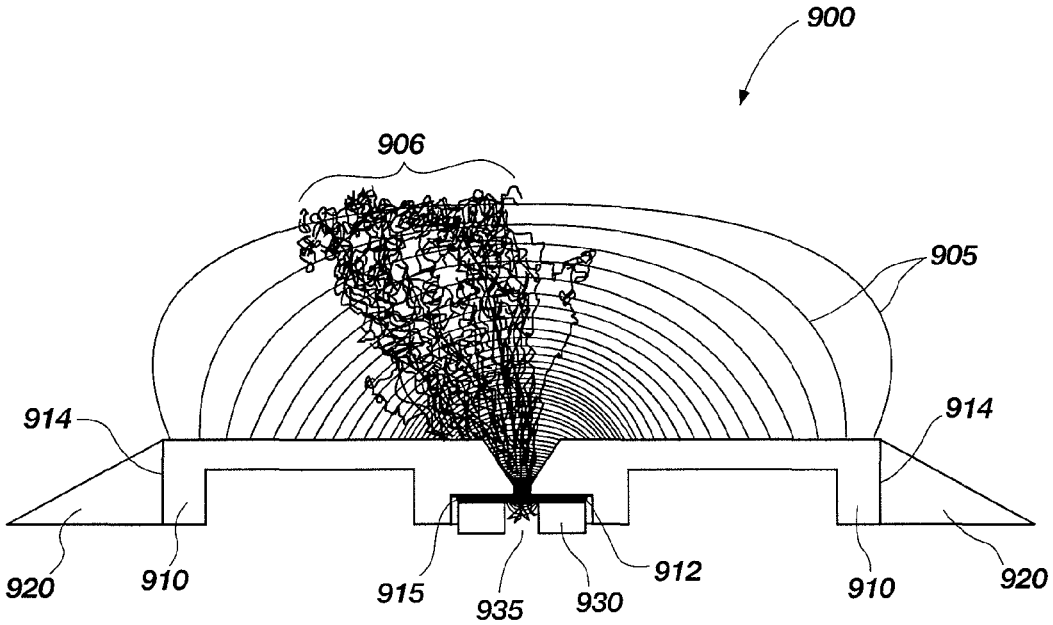
FIGS. 9A and 9B are cross-sectional views of a charged particle guide, such as an ion funnel, according to an embodiment of the present invention.

FIG. 9A a cross-sectional view of a charged particle guide 900, such as an ion funnel, according to an embodiment of the present invention. The charged particle guide 900 may be configured as a disk revolving around an axis of symmetry through the center of aperture 935. In other words, the components on the left may be the same as the components on the right.

The charged particle guide 900 may be used to direct charged particles 906 to a desired location, after which the charged particles 906 may be further analyzed, re-directed, or otherwise processed as desired. An example of a charged particle guide 900 is an ion funnel, which may assist the transfer of charged particles 906 generated at a high-pressure region (e.g., atmospheric region) into a low-pressure region (e.g., a vacuum region) of an instrument, such as a mass spectrometer or an ion mobility spectrometer.

Charged particle guide 900 includes semiconductive material 910 configured for generating an electric field 905 when voltages are applied to the semiconductive material 910 by a voltage source (not shown). For example, a voltage source (not shown) may couple with a first portion 912 and a second portion 914 of the semiconductive material 910 in order to generate a voltage drop across the semiconductive material 910. The voltage source may couple with the first portion 912 and second portion 914 of semiconductive material 910 through conductive contacts 915 and 920, respectively.

The semiconductive material 910 may be shaped in order to generate a complex, substantially nonlinear electric field 905, wherein the shapes of the complex, substantially nonlinear electric field 905 are configured for directing charged particles 906 to a desired location. In FIG. 9A, the desired location for directing charged particles 906 is into aperture 935. Thus, the focal point for the electric field 905 may be near the center of the aperture 935. Aperture 935 may be defined by a structure 930 that may be coupled to an instrument.

The semiconductive material 910 may be configured in a physical shape substantially different from the shape of a generated electric field 905, the generated electric field 905 being generated when a voltage drop exists across the semiconductive material 910. The physical shape of the semiconductive material 910 need not emulate the shape of the electric field 905 generated by the charged particle guide 900. For example, the physical shape may be altered by altering parameters of the semiconductive material 910, such as the thickness, surface area, or length of the semiconductive material 910. Altering such parameters may vary the resistance at different points along semiconductive material 910. Furthermore, the resistance may be varied throughout semiconductive material 910 by combining materials with different resistivities to form semiconductive material 910. The resistance may also vary through temperature changes of the semiconductive material 910.

The charged particle guide 900 may additionally include introducing airflow from the high-pressure region into a lower pressure region to further assist the direction of the charged particles 906 through aperture 935 in addition to influence from electric field 905. Because of the increased flexibility in generating complex electric fields 905, more efficient shapes or focal points of the electric fields 905 may be contemplated. Additionally, the semiconductive material 910 may provide a smoother surface for less turbulent airflow in comparison to conventional approaches. As a result, a greater number of charged particles 906 may be directed into aperture 935 without being neutralized upon contact with the surface of the semiconductive material 910.

Figure 9B:
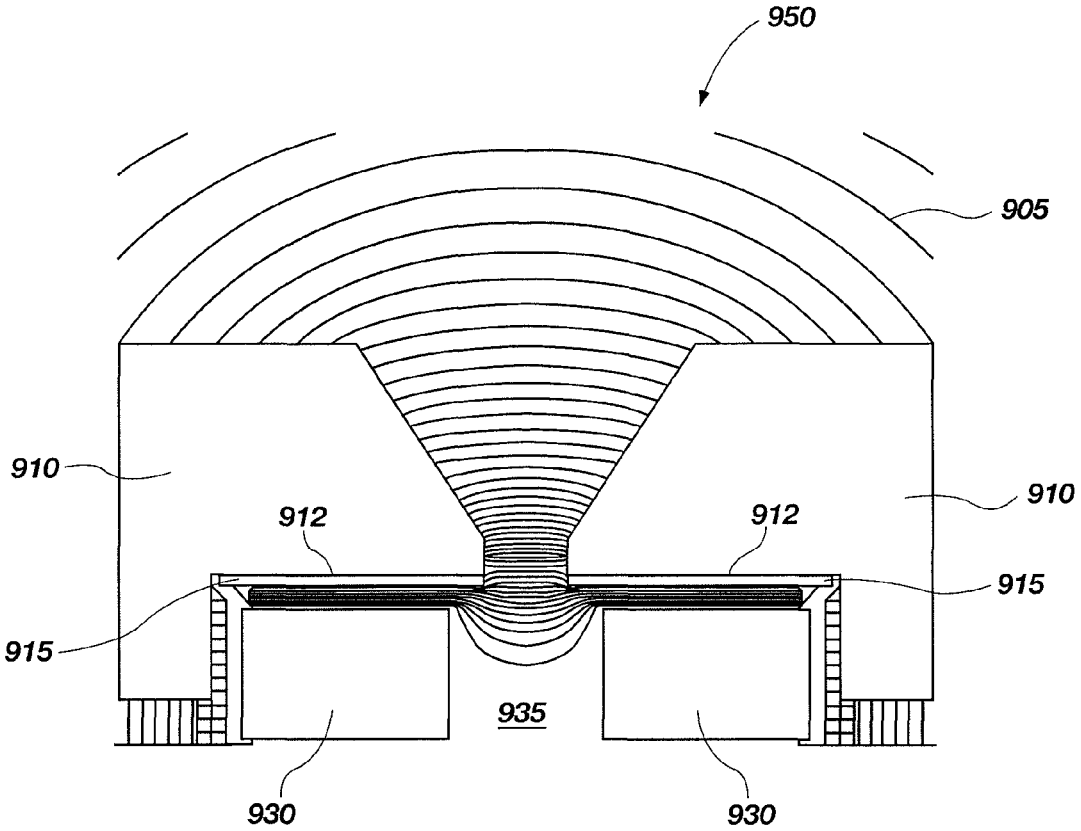

FIG. 9B is a zoomed-in, enlarged, cross-sectional view of a charged particle guide 950 according to an embodiment of the present invention. As shown in FIG. 9B, the electric field 905 exhibits an increasing drop off in the potential down an inlet of the semiconductor material 910 approaching the aperture 935, which electric field 905 may direct charged particles more fully toward the center of the aperture 935 rather than to the walls of the semiconductor material 910.

Figure 10A:
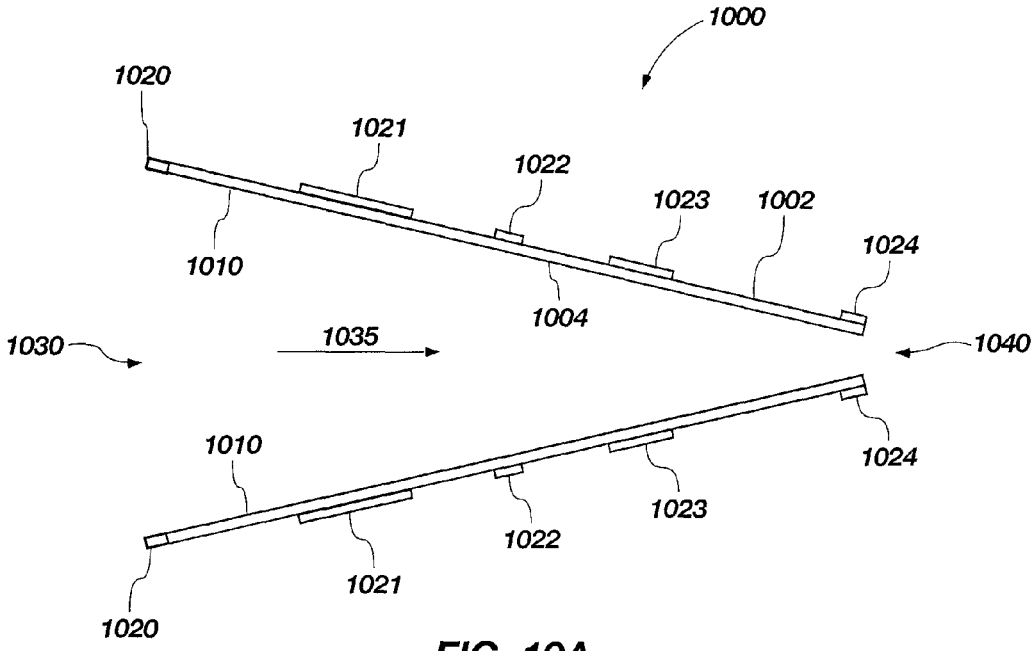
FIGS. 10A and 10B are longitudinal cross-sectional schematic views of an electric field generator and resulting electric fields according to embodiments of the present invention.

FIG. 10A is a longitudinal cross-sectional view of an electric field generator 1000 according to an embodiment of the present invention. Electric field generator 1000 includes semiconductive material 1010, and conductive electrodes 1020-1024. The semiconductive material 1010 is shown in FIG. 10A to be of equal thickness; however, the thickness may also vary (FIG. 10B) to alter the resistance along the electric field generator 1000. The conductive electrodes 1020-1024 may be disposed on an external portion of the semiconductive material 1010 or be at least partially embedded into the semiconductive material 1010. Conductive electrodes 1020-1024 may be formed from a conductive material (e.g., metal or metal alloy). The conductive electrodes 1020-

1024 may be configured as rings around the semiconductive material 1010; however, the conductive electrodes 1020-1024 may be configured to contact discrete locations of the semiconductive material 1010, or to only partially extend around the semiconductive material 1010.

In operation, voltages may be applied to the semiconductive material 1010 as well as to the conductive electrodes 1020-1024. The voltage levels applied to the semiconductive material 1010 and each of the conductive electrodes 1020-1024 may be variable and independent from each other. In such a configuration, the electric field generator 1000 may be configured to direct charged particles (not shown) from one end 1030 of the electric field generator 1000 to another end 1040 of the electric field generator 1000 through an internal path 1035 of the electric field generator 1000. The direction of flow of the charged particles is shown for illustrative purposes, and will depend on the particular configuration of the different components of the electric field generator 1000, as well as the charge (i.e., positive or negative) of the charged particles.

With the conductive electrodes 1020-1024 on an exterior surface 1002 of the electric field generator 1000, the interior surface 1004 of the electric field generator 1000 may be configured to be a smooth surface so as to maintain a laminar airflow (i.e., there are no ridges creating turbulence in the airflow). Additionally, even in this embodiment with conductive electrodes 1020-1024, insulators (not shown) between conductive electrodes 1020-1024 are not exposed to the internal path 1035 where charged particles could be, which lack of exposure may reduce the possibility that insulators become charged and disrupt the desired electric field.

Figure 10B:
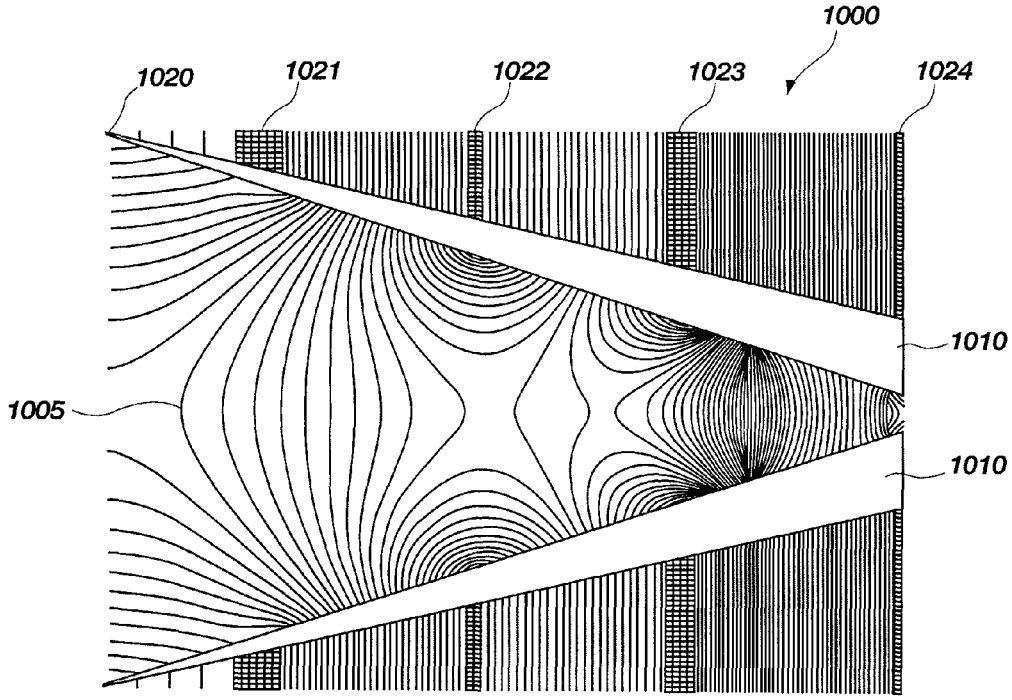

FIG. 10B is a longitudinal cross-sectional view of an electric field generator 1000 according to another embodiment of the present invention. Electric field generator 1000 includes semiconductive material 1010, and conductive electrodes 1020-1024 disposed on an external portion of the semiconductive material 1010 or at least partially embedded into the semiconductive material 1010. Electric field generator 1000 may be configured similar to that of FIG. 10A; however, the thickness of the semiconductive material 1010 is shown in FIG. 10B to vary along the electric field generator 1000, which varied thickness may alter the resistance along the electric field generator 1000.

If voltages are applied across the semiconductive material 1010, as well as to conductive electrodes 1020-1024, an electric field 1005 may be generated. The voltages applied to the different conductive electrodes 1020-1024 may vary depending on the desired electric field 1005. For example, the voltages applied to the different conductive electrodes 1020-1024 may decrease or increase in order from one side of the electric field generator 1000 to the other, such that the boundary voltages along the electric field generator 1000 are monotonic. Alternatively, the voltages may vary along the electric field generator 1000, such that the boundary voltages along the electric field generator 1000 are non-monotonic. For example, the voltage applied to conductive electrode 1024 may be greater than the voltages applied to conductive electrodes 1021 and 1023.

Figure 11A:
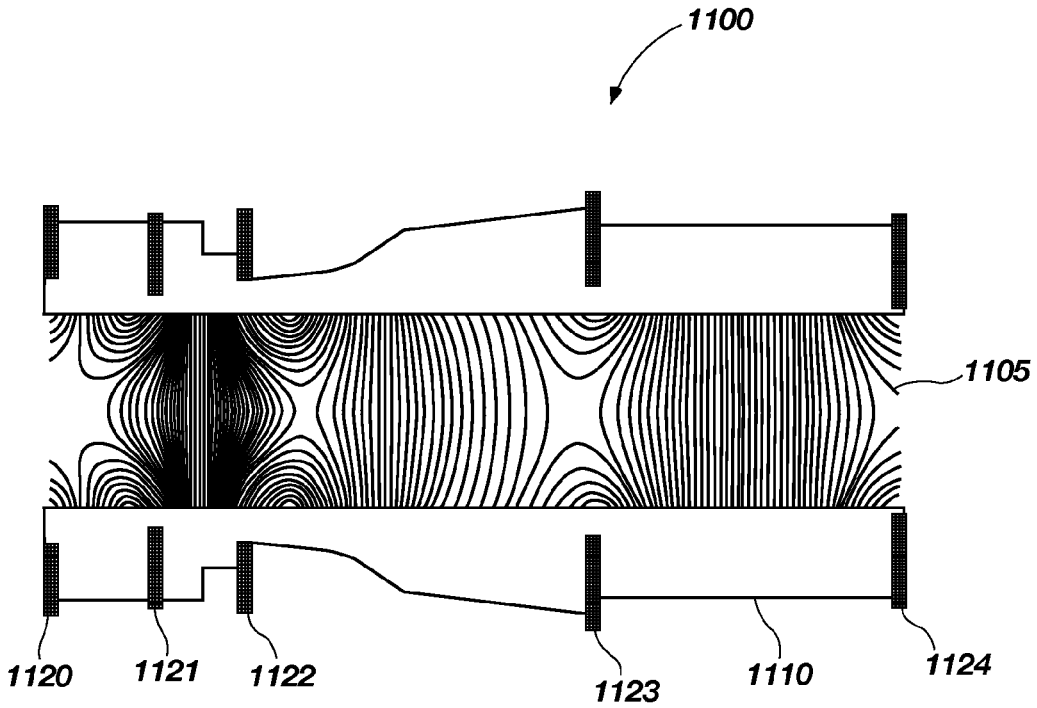
FIGS. 11A and 11B are longitudinal cross-sectional schematic views of an electric field generator and resulting electric fields according to embodiments of the present invention.

FIG. 11A is a longitudinal cross-sectional view of an electric field generator 1100 according to another embodiment of the present invention. Electric field generator 1100 includes semiconductive material 1110, and conductive electrodes 1120-1124 at least partially embedded into the semiconductive material 1110. Electric field generator 1100 may be configured as a cylinder such that a top portion and a bottom portion are the same components rotated about an axis of symmetry through an inner diameter of the cylinder. As shown in FIG. 11A, the thickness of the semiconductive material 1110 may vary along the electric field generator 1100. For example, the portion between conductive electrodes 1121 and 1123 may be formed (e.g., machined) to be non-uniform in thickness in order to vary the resistance along the semiconductive material 1110. Varying the resistance along semiconductive material 1110 may alter the electric field 1105 generated by the electric field generator 1100 when voltages are applied to conductive electrodes 1120-1124.

Figure 11B:
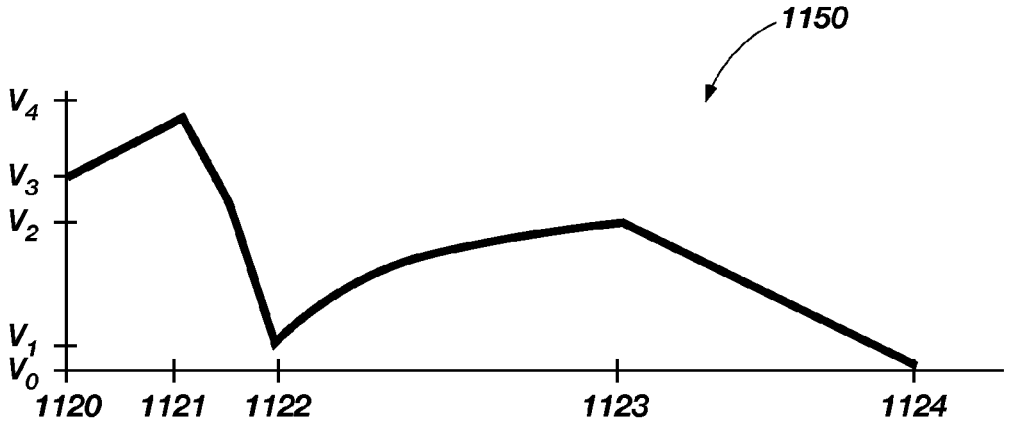

FIG. 11B is a boundary voltage profile 1150 of electric field generator 1100 of FIG. 11A according to an embodiment of the present invention. Voltages $V_0$, $V_1$, $V_2$, $V_3$, and $V_4$ are applied to conductive electrodes 1124, 1122, 1123, 1120, 1121, respectively. Thus, the voltages along the boundary of electric field generator 1100 are non-monotonic. Additionally, as the thickness of the semiconductive material 1110 is uniform between conductive electrodes 1120 and 1121, the voltage increases in a substantially uniform, linear manner. Likewise, as the thickness of the semiconductive material 1110 is uniform between conductive electrodes 1123 and 1124, the voltage decreases in a substantially uniform, linear manner. As the thickness of the semiconductive material 1110 between conductive electrodes 1121, 1122, and 1123 is non-uniform, the voltage increases and decreases in a non-uniform, nonlinear manner.

FIGS. 4 through 11B are examples of the numerous configurations contemplated as embodiments of the present invention. FIGS. 4 through 11B illustrate, among other things, that the shape of an electric field may be altered by shaping semiconductive materials, and that the resulting electric field does not necessarily emulate a physical shape of the semiconductive material. While specific shapes have been shown herein, the number of physical shapes for generating desired electric fields is not limited to those shapes and electric fields shown herein, which are illustrated only as non-limiting examples.

Figure 12A:
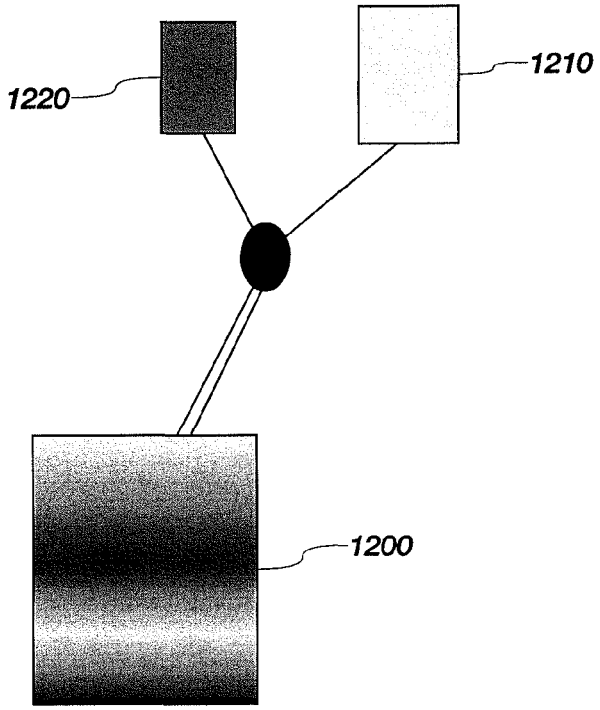
FIGS. 12A and 12B are schematics depicting methods for forming a semiconductive material, which may be used in an electric field generator according to an embodiment of the present invention.

FIG. 12A is a schematic depicting a method for forming a semiconductive material 1200 that may be used in a electric field generator according to an embodiment of the present invention. The semiconductive material 1200 may include a mixture of a first material 1210 with a first resistivity having at least one additional material 1220 dispersed therein. For example, the first material 1210 may include an epoxy base, which by itself may be insulative. The at least one additional material 1220 may include semiconductive materials such as a polymer, carbon nanotube, graphite, ferrite, resistive foam, or other semiconductive materials used to combine with the first material 1210 to vary the resistivity of the resulting semiconductive material 1200. The at least one additional material 1220 may also include a conductive material (i.e., metal or metal alloy), such as silver, in order to create a semiconductive material 1200 with a sufficient resistivity for semiconductive material 1200 to not be purely conductive. The at least one additional material 1220 may further include a plurality of materials, including a combination of one or more of the materials listed above.

The at least one additional material 1220 may be mixed and dispersed into the first material 1210 to create semiconductive material 1200, for example, with the help of a variable mixing station (not shown). The mixing of the first material 1210 and the at least one additional material 1220 may also include the addition of a dispersing agent (e.g., clay) that may further vary the resistivity of the resulting semiconductive material 1200.

The resulting resistivity of semiconductive material 1200 may be uniformly distributed throughout the semiconductive material 1200. Alternatively, the resulting resistivity of semiconductive material 1200 may vary throughout at least a portion of the semiconductive material 1200, which variance is indicated by the different shaded regions of semiconductive material 1200. Varying the resistivity of the semiconductive material 1200 may be accomplished by varying the ratios of first material 1210 to the at least one additional material 1220 when forming the semiconductive material 1200. For example, when pouring the first material 1210 into a mold (not shown), the concentration of the at least one additional material 1220 may be varied in order to vary the resistivity of semiconductive material 1200.

In other words, it is contemplated that the electric field generated by a semiconductive material 1200 may be altered by controlling the distribution of at least one additional material 1220 (e.g., polymer, carbon nanotube, graphite, etc.) in a first material 1210 (e.g., epoxy base, or similar type of materials).

Figure 12B:
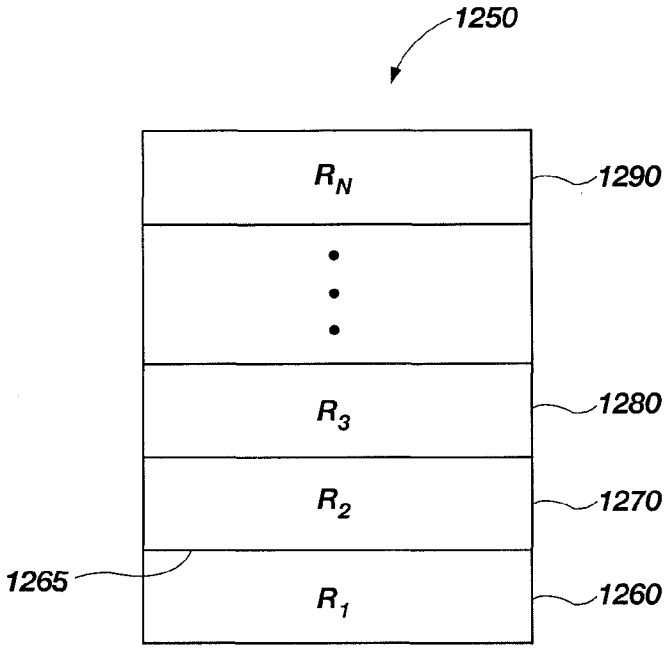

FIG. 12B is a schematic depicting a method for making a semiconductive material 1250, which may be used in an electric field generator according to an embodiment of the present invention. Semiconductive material 1250 may include a plurality of sub-materials 1260-1290, each with varying resistivities $R_1$-$R_N$. For example, sub-materials 1260-1290 have resistivities $R_1$-$R_N$, respectively. Sub-materials 1260-1290, which may also be characterized as precursor materials, may be stacked and laminated together to form semiconductive material 1250, such that transitions between sub-materials (e.g., an interface 1265 between sub-materials 1260 and 1270) are substantially discrete; however, laminating the sub-materials 1260-1290 together may cause some blurring of transitions between sub-materials 1260-1290.

Sub-materials 1260-1290 may be, for example a polymer, carbon nanotube, graphite, ferrite, resistive foam, or other semiconductive materials. Sub-materials 1260-1290 may also include one or more semiconductive materials formed through the method described with respect to FIG. 12A. One of ordinary skill in the art may recognize that although each of sub-materials 1260-1290 may be different; however, some of the sub-materials 1260-1290 may be the same. For example, the semiconductive material used for sub-material 1260 may include the same semiconductive material used for sub-material 1280. In that case, the corresponding resistivities $R_1$ and $R_3$ of sub-materials 1260 and 1280 may be substantially the same.

The semiconductive materials 1200, 1250 of FIGS. 12A and 12B may further be shaped (e.g., machined, cast, etc.) in order to further alter the resulting electric field when applying a voltage to the semiconductive materials 1200, 1250. Machining the semiconductive materials 1200, 1250 may also be desirable to obtain a relatively smooth finish, if desired, for less turbulent airflow.

Depending on the physical shape of semiconductive materials 1200, 1250 and the varying resistivities (e.g., represented by the varied shaded regions of FIG. 12A or by $R_1$-$R_N$ of FIG. 12B), a complex (i.e., nonlinear) electric field may be obtained from semiconductive materials 1200, 1250 formed even in a normal shape (i.e., cylindrical). In another embodiment, a simple (i.e., linear) field may be obtained from a semiconductive material 1200 that is a complex shape (i.e., non-cylindrical). The shape of the resulting electric field generated by semiconductive materials 1200, 1250 need not necessarily emulate the ultimate physical shape of the semiconductive materials 1200, 1250. The flexibility in altering the electric field based on varying the resistivity of the semiconductive materials 1200, 1250 and shaping the semiconductive materials 1200, 1250 may be used to generate functionalized shapes of electric fields generated for directing charged particles to a desired location.

As previously stated, the shape of the electric field may be responsive to the shape of the semiconductive material, the location of the voltage applied to the semiconductive materials, and the resistivity properties of the semiconductive material. For example, referring to FIGS. 5-11, the shapes of the electric fields were described as being altered by shaping semiconductive materials to alter the surface area, length, or thickness of the semiconductive materials. Additionally, the electric fields may be altered by altering a resistance of the semiconductive material. Altering the resistance of the semiconductive material may include laminating together sub-materials of varying resistive properties, controlling the distribution of sub-materials (e.g., one or more conductive, semiconductive, resistive, or insulative materials with different resistivities), or any combination thereof. For example, a semiconductive material such as a conductive polymer may be dispersed in an insulative epoxy base.

Another method for altering the resistance property of the semiconductive material is to vary a temperature of the semiconductive material. For example, at least some of the semiconductive materials that may be used in embodiments of the invention may have a resistance that varies with an experienced temperature change. Therefore, an electric field may be varied by varying the temperature to a portion of the semiconductive material. In some situations, a semiconductive electrode may be an insulator at one temperature and switch to perform as an electrode at another temperature. In other words, the resistance of the semiconductive material may be altered via thermal control (i.e., heating or cooling the material), which may act to alter the shape of the electric field generated by the semiconductive electrode, or even as an "on/off" switch for the electrode. If an electric field generator includes a plurality of semiconductive materials, the different semiconductive materials may be affected differently by the same temperature, which may further alter the generated electric field.

Figure 13:
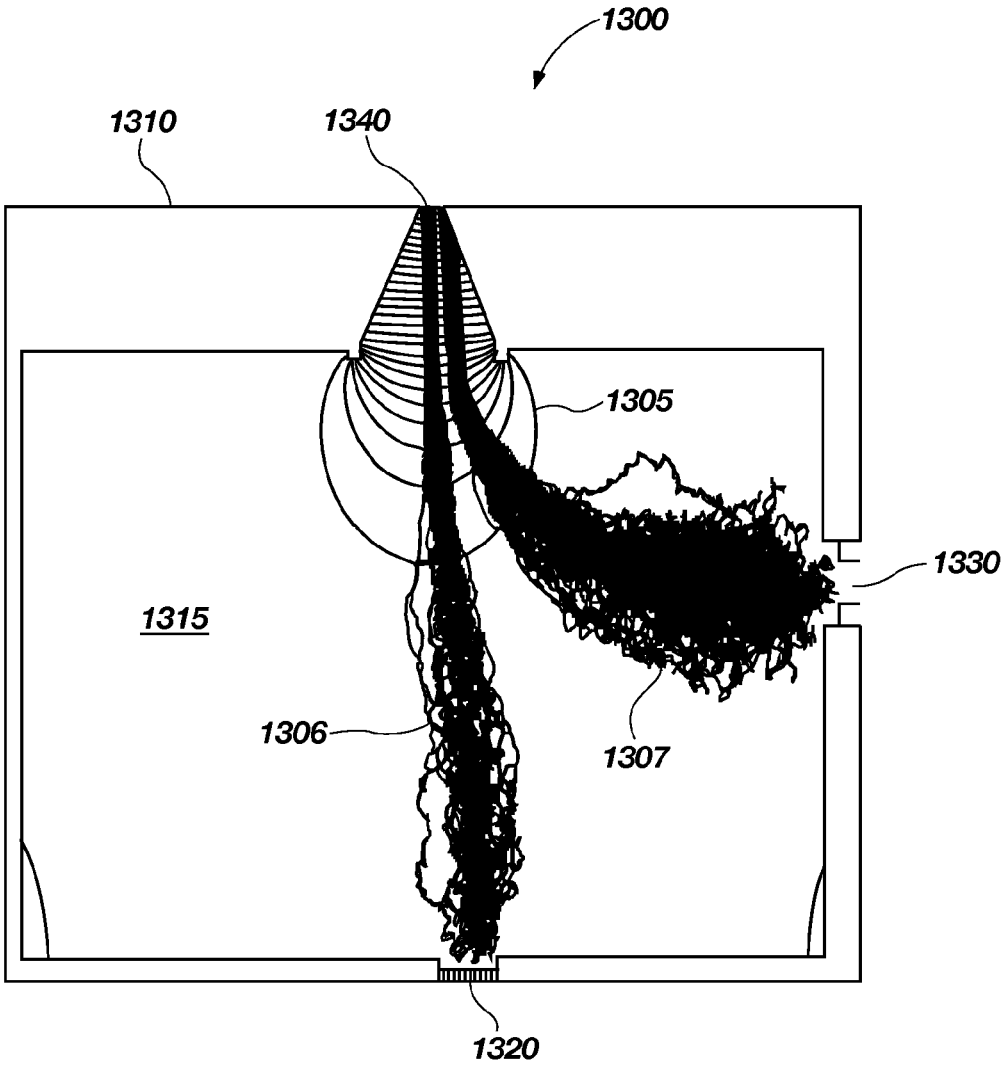
FIG. 13 illustrates a charged particle guide according to another embodiment of the present invention.

FIG. 13 illustrates a charged particle guide 1300 according to another embodiment of the present invention. Charged particle guide 1300 may be implemented within an instrument, which may receive charged particles 1306, 1307 from a plurality of charged particle sources (not shown). For example, the charged particle guide 1300 includes a plurality of inlets 1320, 1330, through which charged particles 1306, 1307 may enter into a chamber 1315 of the charged particle guide 1300. The charged particle guide 1300 includes an outlet 1340, through which charged particles 1306, 1307 may exit the charged particle guide 1300, such as, for example, for further analysis and processing by the instrument. The plurality of inlets 1320, 1330 may be configured according to embodiments of the invention described herein (see, e.g., FIG. 9A) such that charged particles 1306, 1307 generated externally from the charged particle guide 1300 are directed toward the respective inlet 1320, 1330 with the assistance of the generated electric field (not shown) for each inlet 1320, 1330. The charged particle guide 1300 may also be configured to generate an electric field 1305 for directing the charged particles 1306, 1307 toward the outlet 1340. For example, charged particle guide 1300 may include semiconductive material 1310 that may be formed and shaped as previously described herein.

An example of a system including a plurality of inlets 1320, 1330 and an outlet 1340 may include a mass spectrometer that receives charged particles from both laser desorption ionization and electron ionization sources, wherein the instrument has one common outlet leading into the mass analyzer. The electric fields at the plurality of inlets 1320, 1330 for directing and receiving charged particles 1306, 1307 from both charged particle sources (not shown) may be operated simultaneously or separately.

As another example, it is also contemplated that an instrument may include a charged particle guide with an inlet and a plurality of outlets. For example, the inlet may include a generated electric field for receiving charged particles through the inlet from a single charged particle source into a chamber of the charged particle guide. The plurality of outlets may be configured to generate a plurality of electric fields that direct the charged particles toward the plurality of outlets. The electric fields at each of the plurality of outlets may be operated simultaneously or separately. An example of such a system with an inlet and a plurality of outlets may include a situation in which it may be desirable to analyze the charged particles by two or more different methods, such as ion mobility spectrometry and mass spectrometry. In one example, the plurality of outlets may be configured to generate an electric field that attracts charged particles of different polarities. For example, a plasma (i.e., charged particles of both polarities) may be received through an inlet and separated within the chamber of the charged particle guide by the electric fields generated by the plurality of outlets (e.g., one outlet for positively charged particles and another outlet for negatively charged particles). As another example, it is also contemplated that an instrument may include a charged particle guide comprising a plurality of inlets and a plurality of outlets.

Embodiments of the present invention include different methods and apparatuses for generating electric fields that may direct the motion of charged particles. The different apparatuses and methods may include one or more benefits over the conventional approaches. At least some of these potential benefits may include one or more of the following benefits. For example, one benefit may include a simplified construction of instrumentation (fewer parts and connections). Another benefit may include instrumentation that is more robust because of a decreased probability of failure in the fewer parts and connections. Additional benefits may include increased flexibility in making complex electric fields for controlling motion of charged particles through a scientific instrument. As a result, any shape or form factor may be used. The semiconductive material may be smooth so that undesired turbulence in the airflow may be reduced.

Additionally, power supplies, resistive ladders, accompanying electronics and software used to generate and control voltages may be simplified. Because a complex electric field may be generated by as few as one semiconductive part, the instruments employing embodiments of the disclosure may be less susceptible to electrostatic distortion caused by temperature changes. Exposed insulators may be avoided, which may reduce the effects of distortion of the electric field caused by exposed insulators. Less power may be dissipated, lower voltages may be used and fewer electrical connections may be required. Instruments may also be lighter in weight, which may be desirable for miniaturization or aerospace applications. While many advantages and benefits over conventional approaches have been described herein, not all advantages and benefits may be exhibited by every embodiment of the present disclosure. For example, embodiments of the invention may exist in which only one of the advantages is exhibited. Additionally, other advantages and benefits may also be exhibited by embodiments of the present disclosure in addition to, or instead of, those described herein.

While the invention is susceptible to various modifications and implementation in alternative forms, specific embodiments have been shown by way of non-limiting examples in the drawings and have been described in detail herein. However, it should be understood that the invention is not intended to be limited to the particular forms disclosed. Rather, the invention includes all modifications, equivalents, and alternatives falling within the scope of the following appended claims and their legal equivalents.

What is claimed is:

1. An electric field generator, comprising:

a semiconductive material configured in a physical shape of an annular disk having an aperture therein, wherein the semiconductive material has a first thickness for a portion defining the aperture, a second thickness for a portion defining an outer edge of the annular disk, and a third thickness for a portion between the aperture and the outer edge of the annular disk, wherein the third thickness is less than both the first thickness and the second thickness;

a first conductive contact coupled at the portion defining the aperture; and a second conductive contact coupled at the portion defining the outer edge, the first conductive contact and the second conductive contact configured to cause the semiconductive material to generate an electric field when a voltage difference is applied to the first and second conductive contacts.

2. The electric field generator of claim 1, wherein the semiconductive material is selected from the group consisting of graphite, ferrites, glass, resistive foam, polymers, phenolic resins, epoxies, conductive fluids, silicon, germanium, and silicon carbide.

3. The electric field generator of claim 1, wherein the semiconductive material is suspended in a liquid.

4. The electric field generator of claim 1, wherein the semiconductive material exhibits non-uniform resistivity throughout the semiconductive material.

5. The electric field generator of claim 4, wherein the semiconductive material comprises a mixture of a first material and at least one additional material, wherein resistivities of the first material and the at least one additional material are different.

6. The electric field generator of claim 5, wherein the first material comprises an epoxy base.

7. The electric field generator of claim 5, wherein the at least one additional material comprises at least one of a semiconductive material, a conductive material, and a resistive material.

8. The electric field generator of claim 4, wherein the semiconductive material comprises a plurality of sub-materials of varying resistivities.

9. The electric field generator of claim 1, wherein the shape of the electric field to be generated is a complex, nonlinear shape.

10. The electric field generator of claim 1, further comprising a charged particle guide that includes the semiconductive material, wherein the charged particle guide is operably coupled between a high-pressure region and a low-pressure region.

11. The electric field generator of claim 10, wherein the low-pressure region comprises a vacuum chamber of an instrument for processing charged particles.

12. The electric field generator of claim 1, wherein the first thickness and the second thickness are substantially the same thickness.

* * * * *